US009200398B2

(12) United States Patent
Poy

(10) Patent No.: US 9,200,398 B2
(45) Date of Patent: Dec. 1, 2015

(54) CONTINUOUS BATCH TUNNEL WASHER AND METHOD

(71) Applicant: PELLERIN MILNOR CORPORATION, Kenner, LA (US)

(72) Inventor: Russell H. Poy, New Orleans, LA (US)

(73) Assignee: PELLERIN MILNOR CORPORATION, Kenner, LA (US)

( * ) Notice: Subject to any disclaimer, the term of this patent is extended or adjusted under 35 U.S.C. 154(b) by 0 days.

(21) Appl. No.: 13/971,336

(22) Filed: Aug. 20, 2013

(65) Prior Publication Data

US 2014/0053343 A1 Feb. 27, 2014

Related U.S. Application Data

(60) Provisional application No. 61/818,882, filed on May 2, 2013, provisional application No. 61/765,484, filed on Feb. 15, 2013, provisional application No. 61/691,140, filed on Aug. 20, 2012.

(51) Int. Cl.
*D06F 35/00* (2006.01)
*D06F 31/00* (2006.01)

(52) U.S. Cl.
CPC ..... *D06F 31/00* (2013.01); *D06F 31/005* (2013.01)

(58) Field of Classification Search
CPC ..... D06F 31/005; D06F 31/00; D06F 3/28; B22F 2999/00; B22F 2202/13
USPC ..... 8/158, 159, 137, 147; 68/27, 58, 143, 68/207, 140, 24, 5 D, 9, 145; 134/64 R, 10, 134/111, 122 R, 26, 120, 131, 152
See application file for complete search history.

(56) References Cited

U.S. PATENT DOCUMENTS 4,236,393 A 12/1980 Katzfey
4,478,060 A * 10/1984 Grunewald ..... 68/27

(Continued)

FOREIGN PATENT DOCUMENTS

JP 2001137590 A 5/2001
RU 2045593 C1 10/1995

(Continued)

OTHER PUBLICATIONS

Potochnaya stiralnaya liniya Universal. Jensen [online] [retrieved on Nov. 28, 2013]. Retrieved from the Internet: <URL: http://www.jensen-moscow.ru/potok.html>.

(Continued)

*Primary Examiner* — Michael Barr
*Assistant Examiner* — Thomas Bucci
(74) *Attorney, Agent, or Firm* — Garvey, Smith, Nehrbass & North, L.L.C.; Charles C. Garvey, Jr.; Vanessa M. D'Souza

(57) ABSTRACT

A method of washing fabric articles in a tunnel washer that includes moving the fabric articles from the intake of the washer to the discharge of the washer and through multiple modules or sectors. Liquid can be counter flowed in the washer interior along a flow path that is generally opposite the direction of travel of the fabric articles in order to rinse the fabric articles. While counterflow rinsing, the flow rate can be maintained at a selected flow rate or flow pressure head. One or more booster pumps can optionally be employed to maintain constant counterflow rinsing flow rate or constant counterflow rinsing pressure head. A source of fresh, make-up water can be provided to adjust conductivity. Conductivity is monitored in at least one of the modules. Conductivity of fluid in the discharged fabric articles is monitored. Make up water is added to one or more modules before if the conductivity of water in the discharged fabric articles exceeds a threshold value. In one embodiment, one of the modules is an empty pocket that is drained of fluid when rinsing with counterflowing liquid.

35 Claims, 27 Drawing Sheets

(56) References Cited

U.S. PATENT DOCUMENTS

| | | | | |
|---|---|---|---|---|
| 4,485,509 | A | 12/1984 | Pellerin et al. | |
| 4,522,046 | A | 6/1985 | Dreher | |
| 4,546,511 | A * | 10/1985 | Kaufmann | 8/158 |
| 5,211,039 | A | 5/1993 | Pellerin | |
| 5,454,237 | A | 10/1995 | Pellerin | |
| 7,971,302 | B2 | 7/2011 | Poy et al. | |
| 8,166,670 | B2 | 5/2012 | Poy | |
| 8,336,144 | B2 | 12/2012 | Poy et al. | |
| 8,365,435 | B2 | 2/2013 | Poy et al. | |
| 8,370,981 | B2 | 2/2013 | Poy et al. | |
| 2011/0296626 | A1 | 12/2011 | Poy | |

FOREIGN PATENT DOCUMENTS

| | | | |
|---|---|---|---|
| RU | 02174170 | C1 | 9/2001 |
| RU | 2007146118 | A | 6/2009 |
| WO | 2007124918 | A1 | 11/2007 |

OTHER PUBLICATIONS

International Search Report and Written Opinion for PCT/US13/55768, Jan. 10, 2014.

* cited by examiner

CONTINUOUS BATCH TUNNEL WASHER AND METHOD

CROSS-REFERENCE TO RELATED APPLICATIONS

This is a nonprovisional patent application of U.S. Provisional Patent Application Ser. No. 61/691,140, filed 20 Aug. 2012; U.S. Provisional Patent Application Ser. No. 61/765,484, filed 15 Feb. 2013; and U.S. Provisional Patent Application Ser. No. 61/818,882, filed 2 May 2013, each of which is hereby incorporated herein by reference.

Priority of U.S. Provisional Patent Application Ser. No. 61/691,140, filed 20 Aug. 2012; U.S. Provisional Patent Application Ser. No. 61/765,484, filed 15 Feb. 2013; and U.S. Provisional Patent Application Ser. No. 61/818,882, filed 2 May 2013, each of which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to continuous batch washers or tunnel washers. More particularly, the present invention relates to an improved method of washing textiles or fabric articles (e.g., clothing, linen) in a continuous batch multiple module tunnel washer wherein the textiles are moved sequentially from one module to the next module and wherein one or more modules have conductivity sensors that monitor water conductivity. Water is selectively transferred in order to maintain water conductivity to within a pre-selected acceptable range which aids in proper ironing of textile articles.

2. General Background of the Invention

Currently, washing in a commercial environment is conducted with a continuous batch tunnel washer. Such continuous batch tunnel washers are known (e.g., U.S. Pat. No. 5,454,237) and are commercially available (www.milnor-.com). Continuous batch washers have multiple sectors, zones, stages, or modules including for example, pre-wash, wash, rinse and finishing zone.

Commercial continuous batch washing machines in some cases utilize a constant counterflow of liquor. Such machines are followed by a centrifugal extractor or mechanical press for removing most of the liquor from the goods before the goods are dried. Some machines carry the liquor with the goods throughout the particular zone or zones.

When a counterflow is used in the prior art, there is counterflow during the entire time that the fabric articles or textiles are in the main wash module zone. This practice dilutes the washing chemical and reduces its effectiveness.

A final rinse with a continuous batch washer has been performed using a centrifugal extractor or mechanical press. A problem occurs in prior art systems when the water that is used for the press has a conductivity that exceeds a preset limit (for example, about 1,000 microsiemens) above incoming fresh water. In such a case, the press water with excessive conductivity can cause the linen to stick to ironing implements such as an ironer roll that rests upon a chest. Without proper rinsing with water having proper conductivity, the linen can stick on the chest part of the ironer roll.

Patents have issued that are directed to batch washers or tunnel washers. The following table provides examples of such patented tunnel washers, each listed patent of the table being hereby incorporated herein by reference.

TABLE

| PAT. NO. | TITLE | ISSUE DATE MM-DD-YYYY |
|---|---|---|
| 4,236,393 | Continuous tunnel batch washer | 12-02-1980 |
| 4,485,509 | Continuous batch type washing machine and method for operating same | 12-04-1984 |
| 4,522,046 | Continuous batch laundry system | 06-11-1985 |
| 5,211,039 | Continuous batch type washing machine | 05-18-1993 |
| 5,454,237 | Continuous batch type washing machine | 10-03-1995 |

BRIEF SUMMARY OF THE INVENTION

The present invention provides an improved method of washing fabric articles in a continuous batch tunnel washer. The method includes providing a continuous batch tunnel washer having an interior, an intake, a discharge, a plurality of modules, and a volume of liquid.

The present invention provides an improved method and apparatus for washing or laundering items in a continuous batch or tunnel washer. The present invention provides an improved method and apparatus for laundering articles in a continuous batch or tunnel washer that also employs an extractor such as a centrifuge or press, solving a problem that results in a sticking or adherence of the linen to the chest of an ironer roll because of improper conductivity of the water.

The present invention provides a tunnel washer or continuous batch washer that employs conductivity sensors located in one or more positions such as for example the press tank, incoming fresh water stream, and "pulse flow" tank.

In one embodiment, the maximum conductivity range of the press water is compared to incoming fresh water.

In one embodiment, the maximum conductivity range of the pulse flow tank water is compared to incoming fresh water.

In one embodiment, if the press water conductivity exceeds a preset limit (for example, 1,000 microsiemens above incoming fresh water), the fresh water then flows from one of the modules (for example, the last module) into the press tank such as for example during a "pulse flow" or higher velocity flow time of a transfer cycle.

In this manner, the conductivity of the press water will be adjusted (e.g., lowered) back to a pre-programmed, pre-selected acceptable range. The present invention thus corrects a problem before the pulse flow tank can reach a conductivity that is beyond a desired or selected range.

With the present invention, if an upset condition occurs in the pulse flow tank (i.e., exceeding its programmed range), a drain valve can be used to discharge water flow directly into the tank to correct the upset condition.

An alternate method provides an "empty pocket" that is inserted into a module such as module 1 (e.g., first module) with the drain open. The "empty pocket" is simply a module that is purposefully not filled with fabric articles (e.g. linen, clothing, or the like). Water from a pump counter flows from one of the later modules (e.g. module 8) to sewer through the first module drain. Upon the next transfer of fabric articles to the next downstream module, the "empty pocket" advances to second module, then to the third module and so forth. For an eight module washer, the empty pocket will initially be the first module or module 1. The empty pocket then moves to the second module or module 2. The empty pocket then moves in sequence to module three, then module 4, then module 5 then module 6 then module 7 and finally module 8 is the empty pocket. In each module that is the empty pocket, the water from the pump is diverted to sewer. This method recovers the over conductivity measured in the press water faster because the free water that has too high a conductivity in the pulse flow zone is cleared faster by diverting the pulse flow water into the advancing "empty pocket" that has no clothing, linen, or fabric articles. This alternate method minimizes the time out of range conductivity by about 40 to 50% (one method requires 6 to 10 transfers to clear the conductivity error whereas the alternate method only requires 2 to 6 transfers).

The present invention includes a method of washing fabric articles in a continuous batch tunnel washer. The method can provide a continuous batch tunnel washer having an interior, an intake, a discharge, a plurality of modules, and a volume of liquid. The fabric articles can be moved from the intake to the modules and then to the discharge in sequence. A washing chemical can be added to the volume of liquid. The fabric articles can be discharged after to an extractor that removes excess water from the fabric articles, discharging said excess water to a press water tank. An ironer can be provided that receives fabric articles. Conductivity can be monitored of fluid in at least one of the modules. Conductivity can be monitored of fluid in the press water tank. Water can be added to one or more modules if the conductivity of water in the press water tank exceeds a threshold value so that the fabric articles to be ironed hold only water with a conductivity that is within an acceptable conductivity range.

In one embodiment, the extractor can be a press.

In one embodiment, the extractor can be a centrifuge.

In one embodiment, the threshold value can be about 1000 microSiemens per centimeter.

In one embodiment, the threshold value can be between about 100 micro Siemens and 1000 micro Siemens above the conductivity value of the incoming or available water or source water.

In one embodiment, the invention further includes the step of after a selected time period, counter flowing a rinsing liquid along a flow path that can be generally opposite the direction of travel of the fabric articles.

In one embodiment, the water added can be a fresh influent water stream.

The present invention includes a method of washing and drying fabric articles in a continuous batch tunnel washer and ironer. The method can provide a continuous batch tunnel washer having an interior, an intake, a discharge, and a plurality of modules that segment the interior. The fabric articles can be moved from the intake to the discharge. A washing chemical can be added to one or more of the modules. The fabric articles can be discharged. A source of fresh, make-up water can be provided. Conductivity can be monitored of fluid in at least one of the modules. Conductivity can be monitored of fluid in the discharged fabric articles. Make-up water can be added to one or more modules if the conductivity of water in the discharged fabric articles exceeds a threshold value.

In one embodiment, the present invention further includes the step of extracting water from the fabric articles, the extracted water can be monitored for said conductivity to provide the value of conductivity for the discharged fabric articles.

In one embodiment, the threshold value is at least about 100 micro Siemens above the conductivity value of the incoming or available water or source water.

In one embodiment, the present invention further includes maintaining the conductivity of the water in the discharged fabric articles to a value of between about between about 100 micro Siemens and about 1000 micro Siemens above the conductivity value of the incoming or available water or source water.

The present invention includes a method of washing fabric articles in a continuous batch tunnel washer. The method provides a continuous batch tunnel washer having an interior, an intake, a discharge, and a plurality of modules that segment the interior and wherein one of the modules is an empty pocket that is drained of water. Fabric articles can be moved from the intake to the discharge and through the modules in sequence. A washing chemical can be added to one or more of the modules. The fabric articles can be rinsed by counter flowing liquid in the washer interior along a flow path that is generally opposite the direction of travel of the fabric articles, wherein one of the modules defines and empty pocket that is drained of water during this step, wherein one of the modules can be an empty pocket that is drained of fluid during such rinsing with counterflowing liquid. Wherein one of the modules can be an empty pocket that is drained of fluid.

In one embodiment, one of the modules can be an empty pocket that is drained of fluid and that does not have any fabric articles such as linens.

In one embodiment, the invention further comprises extracting excess fluid from the fabric articles.

In one embodiment, the empty pocket is moved from an upstream location to a downstream location. For example, for an eight module washer, the empty pocket moves from the first module at the intake end of the washer and then to modules 2, 3, 4, 5, 6, 7, 8 in sequence.

In one embodiment, the empty pocket separates white fabric articles from non-white fabric articles.

In one embodiment, the empty pocket separates white fabric articles from colored fabric articles.

In one embodiment, the empty pocket separates higher temperature modules from lower temperature modules.

The present invention includes a method of laundering fabric articles in a continuous batch tunnel washer. The method can provide a continuous batch tunnel washer having an interior, an intake, a discharge, and a plurality of modules that segment the interior. Fabric articles can be moved in a first direction of travel from the intake to the discharge. The fabric articles can be washed with a chemical bath in one or more of said modules. The fabric articles can then be rinsed. An empty pocket can be provided in one or more of said modules that is drained of fluid. Wherein the empty pocket is moved in a direction from the intake towards the discharge. Liquid can be counterflowed in the washer during the step of rinsing the fabric.

Another embodiment of the present invention includes a method of washing fabric articles in a continuous batch tunnel washer, comprising the steps of: a) providing a continuous batch tunnel washer having an interior, an intake, a discharge, and a plurality of modules that segment the interior and wherein one of the modules is an empty pocket that is drained of water, said modules including a first module next to the intake and a final module next to the discharge; b) moving the fabric articles from the intake to the discharge and through the modules in a sequence beginning with the first module and ending with the final module; c) adding a washing chemical to one or more of the modules; d) rinsing the fabric articles by counter flowing liquid in the washer interior along a flow path that is generally opposite the direction of travel of the fabric articles in steps "b" and "c"; e) wherein one of the modules defines an empty pocket module that is drained of fluid during step "d"; and f) wherein the modules that are not empty pocket modules contain both fabric articles and fluid.

In another embodiment, the method of the present invention further comprises extracting excess fluid from the fabric articles after step "e". In one embodiment, the empty pocket is moved from an upstream location to a downstream location.

In another embodiment of the method of the present invention, the empty pocket separates white fabric articles from non-white fabric articles, and in another embodiment, the empty pocket separates white fabric articles from colored fabric articles. In another embodiment, the empty pocket separates higher temperature modules from lower temperature modules.

In another embodiment of the method of the present invention, there are multiple different counterflow streams in step "d". In one embodiment, one counterflow stream in step "d" rinses white fabric articles and another counterflow stream rinses the non-white fabric articles. In one embodiment, one counterflow stream in step "d" rinses white fabric articles and another counterflow stream rinses colored articles. In another embodiment one counterflow stream rinses higher temperature modules and another counterflow stream rinses lower temperature modules.

Another embodiment of the present invention includes a method of laundering fabric articles in a continuous batch tunnel washer, comprising the steps of: a) providing a continuous batch tunnel washer having an interior, an intake, a discharge, and a plurality of modules that segment the interior; b) moving the fabric articles and fluid in a first direction of travel from the intake to the discharge; c) washing the fabric articles with a chemical bath in one or more of said modules; d) rinsing the fabric articles after step "c"; e) providing an empty pocket in one or more of said modules that is drained of fluid; f) wherein the empty pocket is moved from one module to the next module in sequence, and in a direction from the intake towards the discharge; and g) counterflowing liquid in the washer during step "d".

Another embodiment of the present invention includes a method of washing fabric articles in a continuous batch tunnel washer, comprising the steps of: a) providing a continuous batch tunnel washer having an interior, an intake, a discharge, and a plurality of modules that segment the interior and wherein one of the modules is an empty pocket that is drained of water; b) moving the fabric articles and a volume of liquid from the intake to the discharge and through the modules in sequence; c) adding a washing chemical to one or more of the modules; d) rinsing the fabric articles by counter flowing liquid in the washer interior along a flow path that is generally opposite the direction of travel of the fabric articles in steps "b" and "c"; and e) wherein one of the modules defines an empty pocket module that is drained of liquid during step "d".

In another embodiment of the method of the present invention, the method further comprises extracting excess fluid from the fabric articles after step "e".

In another embodiment of the method of the present invention, the empty pocket is moved from an initial upstream location to downstream modules that are downstream of said initial upstream location.

Another embodiment of the present invention includes a method of laundering fabric articles in a continuous batch tunnel washer, comprising the steps of: a) providing a continuous batch tunnel washer having an interior, an intake, a discharge, and a plurality of modules that segment the interior and including at least one intake module and at least one final module; b) moving the fabric articles in a first direction of travel from the intake to the discharge; c) washing the fabric articles with a chemical bath in one or more of said modules; d) rinsing the fabric articles after step "c"; e) providing an empty pocket in one or more of said modules that is drained of fluid; f) wherein the empty pocket is moved one module at a time starting at the intake module and ending at the final module, and in a direction from the intake towards the discharge; and g) counterflowing liquid in the washer during step "d".

In another embodiment of the method of the present invention, the empty pocket separates white fabric articles from non-white fabric articles, and in another embodiment the empty pocket separates white fabric articles from colored fabric articles. In one embodiment the empty pocket separates higher temperature modules from lower temperature modules.

In another embodiment of the method of the present invention, there are multiple different counterflow streams in step "g". In one embodiment one counterflow stream in step "d" rinses white fabric articles and another counterflow stream rinses non-white fabric articles. In another embodiment, one counterflow stream in step "d" rinses white fabric articles and another counterflow stream rinses colored fabric articles. In another embodiment of the method of the present invention one counterflow stream rinses higher temperature modules and another counterflow stream rinses lower temperature modules.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1A:
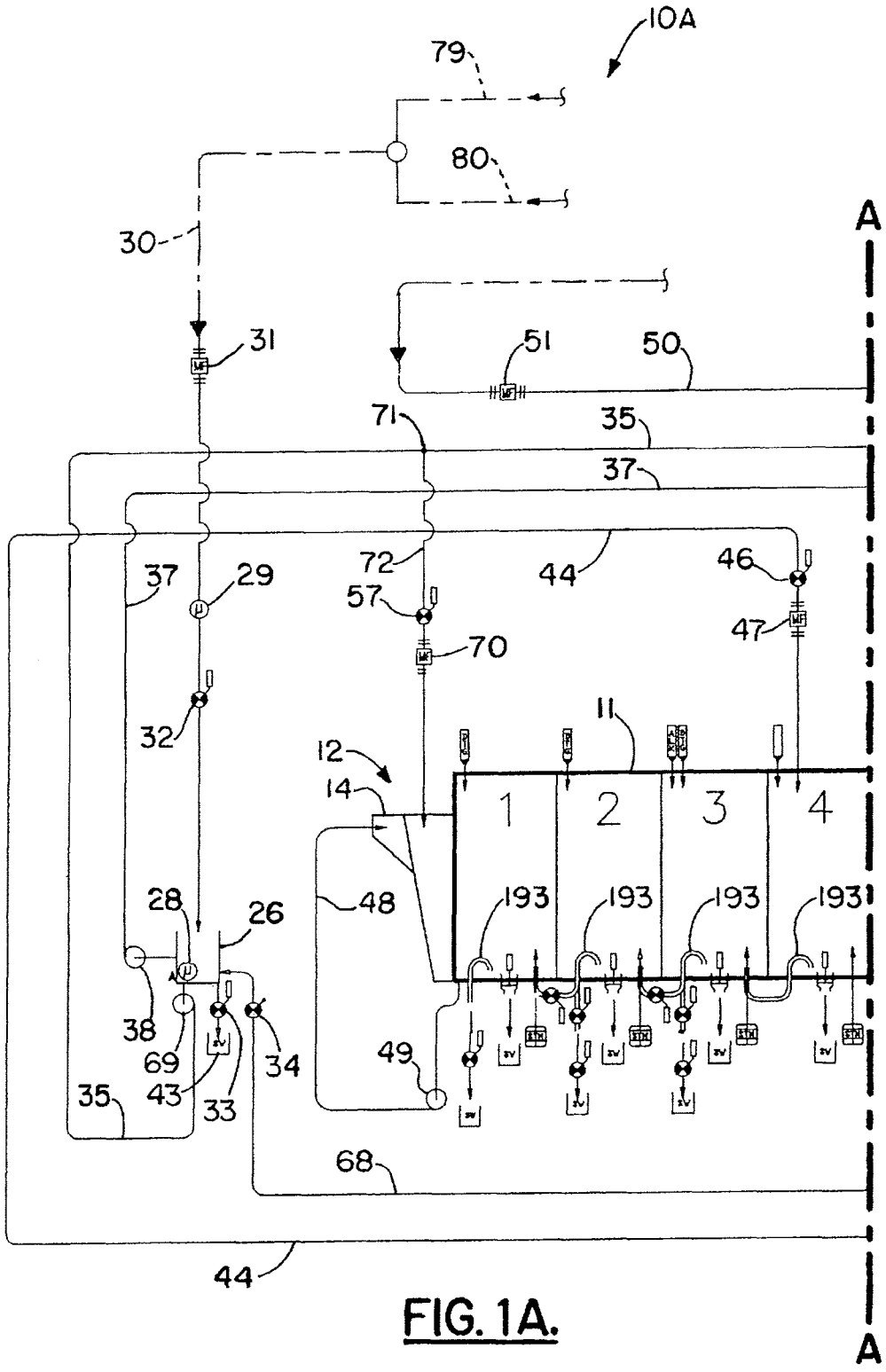
FIG. 1 is comprised of half FIGS. 1A-1B that connect at match lines A-A, providing a schematic diagram showing a preferred embodiment of the apparatus of the present invention.
Figure 1B:
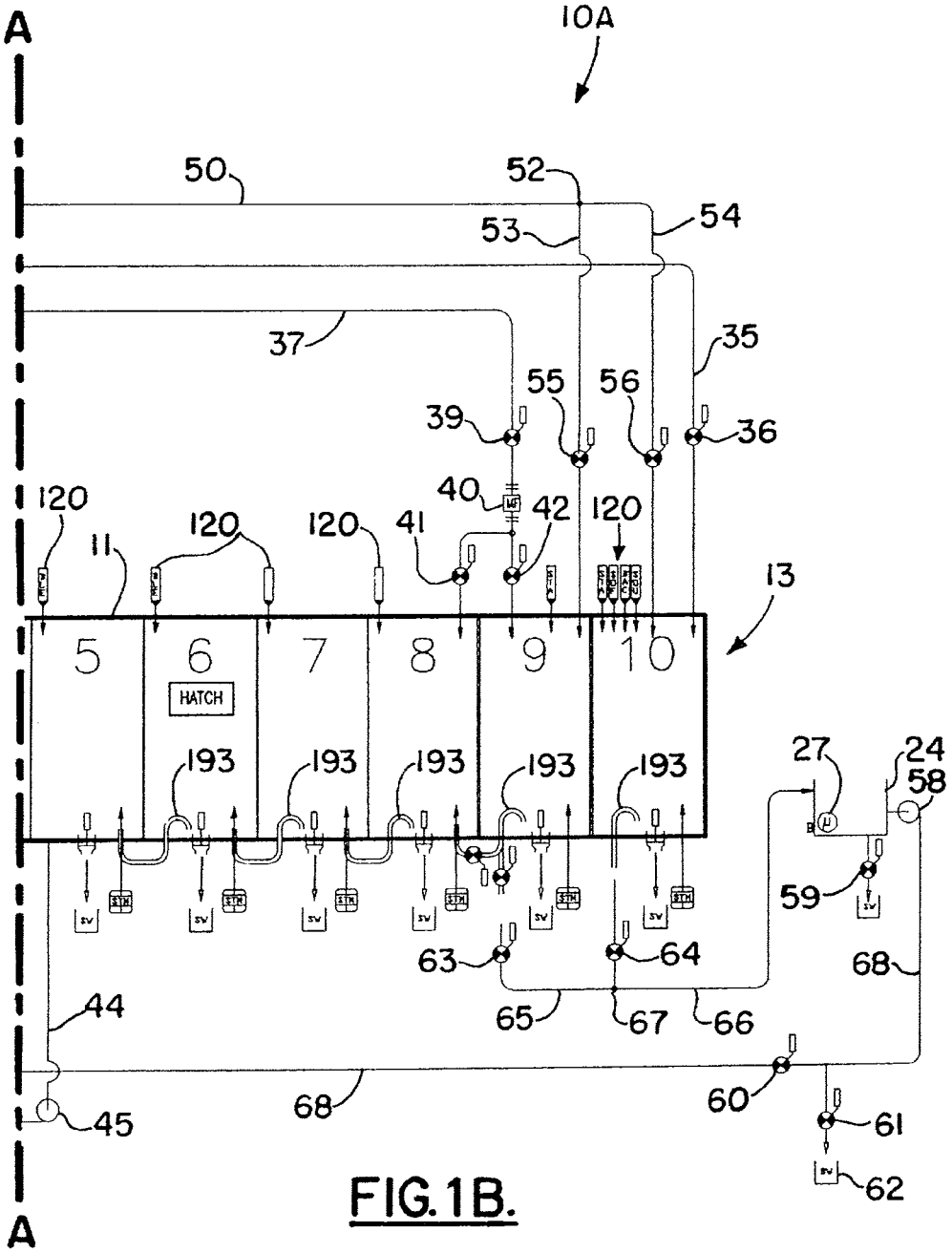
Figure 2A:
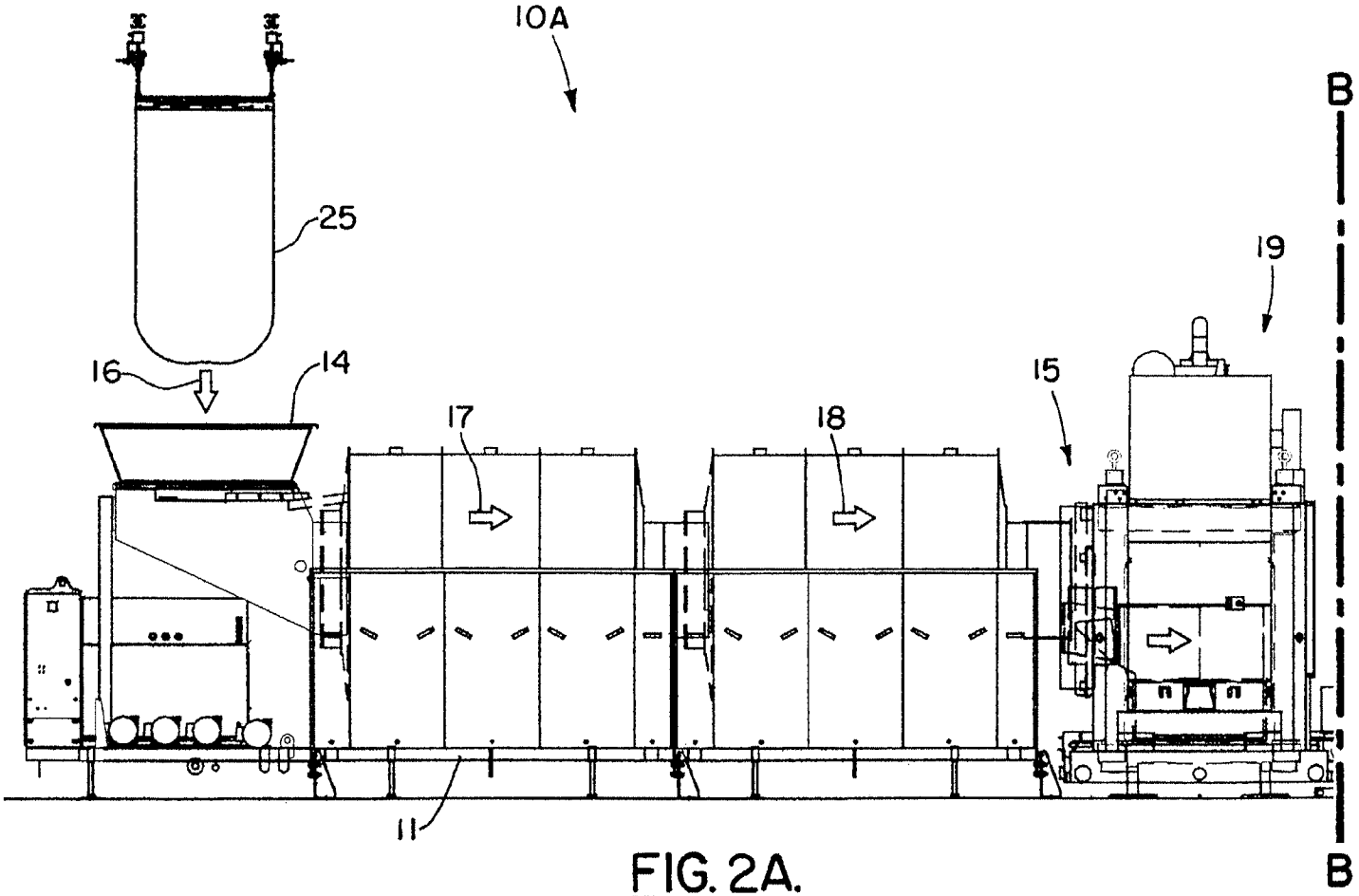
FIG. 2 is comprised of half FIGS. 2A-2B that connect at match lines B-B providing a schematic diagram showing a preferred embodiment of the apparatus of the present invention.
Figure 2B:
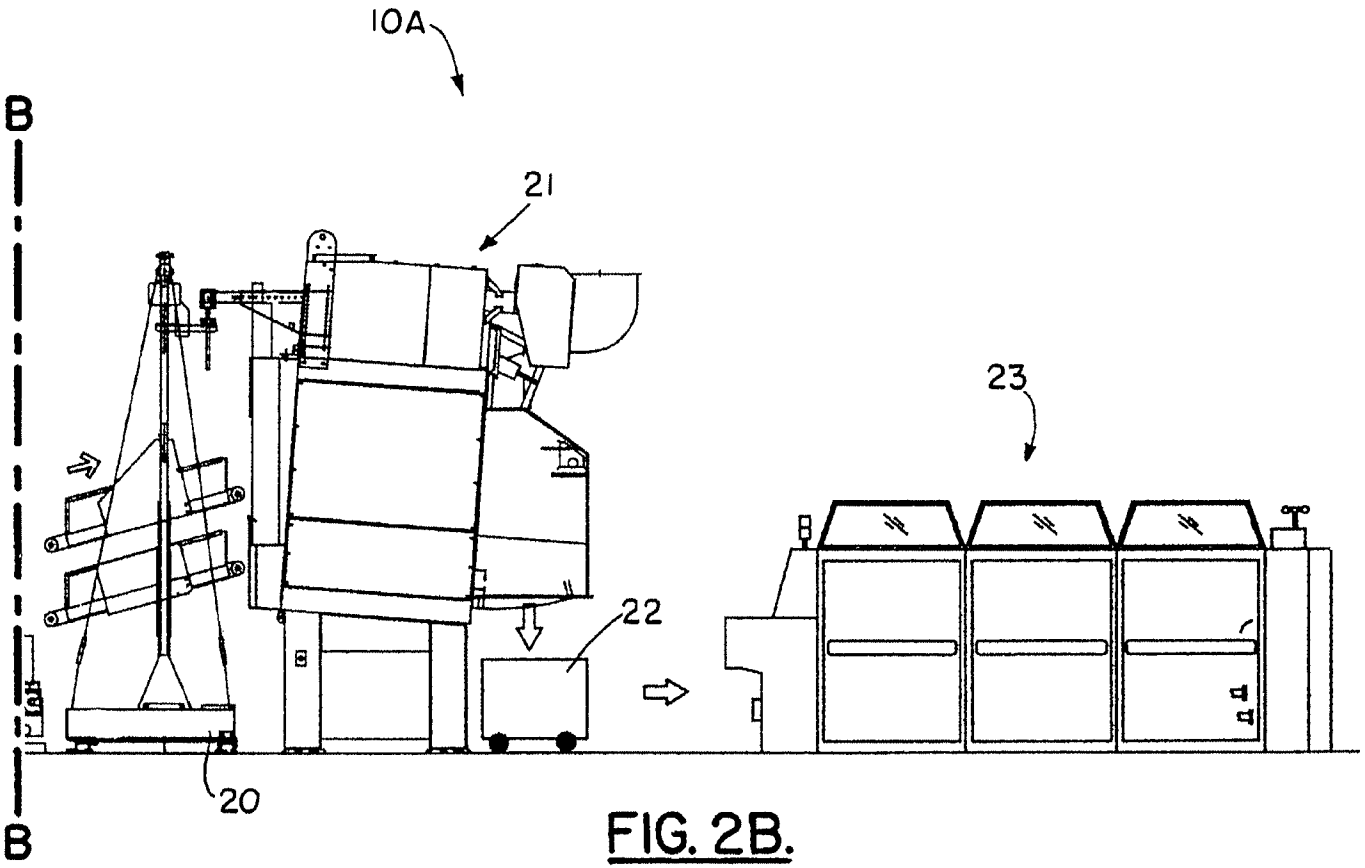

FIGS. 1-2 show a preferred embodiment of the apparatus of the present invention designated generally by 10A in FIGS. 1 and 2. It should be understood that FIG. 1 includes half FIGS. 1A and 1B that assemble at match lines A-A. FIG. 2 includes half FIGS. 2A and 2B that assemble at match lines B-B. In FIG. 1 there can be seen a textile washing apparatus 10A which employs a tunnel washer 11 having an inlet end portion 12 and an outlet end portion 13. The inlet end portion 12 has a hopper 14 that enables the tunnel washer 11 to accept soiled linen or fabric articles 25 as indicated generally by arrow 16 in FIG. 2. A discharge 15 from tunnel washer 11 enables laundered articles such as linen to be transferred from tunnel washer 11 to an extractor the removes water such as a press 19. From the press or extractor 19, the laundered articles can be moved using a shuttle 20 to a dryer 21 and then via transport 22 to a finishing station 23 (see FIG. 2). The tunnel washer 11 provides a plurality of modules or stations 1, 2, 3, 4, 5, 6, 7, 8, 9, 10. Fabric articles to be cleaned are moved generally in the direction of arrows 17, 18 in FIG. 2. Counterflow flow lines 193 are provided for counterflowing fluid from one module (e.g. module 4) to the previous module (module 3). Such counterflow flow lines 193 can be provided for each embodiment of FIGS. 1-24 to counterflow fluid from any downstream module to an upstream module or in a direction opposite to arrows 17, 18. In FIG. 1, there is provided an extractor reuse tank 24 and a "pulse flow" tank 26. "Pulse flow" tank 26 provides a supply of water to pumps 38, 69. These pumps then transmit water at a high flow rate (e.g., between 75 (283) and 250 (946.4) gallons (liter) per minute) to a selected module or modules.

A plurality of conductivity sensors are provided as part of the apparatus 10A. In FIG. 1, a conductivity sensor 27 is provided in the extractor reuse tank 24. Another conductivity sensor 28 is provided in the pulse flow tank 26. A third conductivity sensor 29 is provided in the influent flow line 30 to monitor the conductivity of fresh water that is flowing through the influent flow line 30 (from a selected source). The source of fresh water in flow line 30 can include a cold source 79 of fresh water as well as a hot or tempered source 80 of fresh water. The present invention monitors conductivity of water that is contained in the modules 1-10 and adjusts by adding fresh water or make up water in order to maintain the conductivity in modules 1-10 within a selected or desired range (i.e. between about 100 micro Siemens (minimum value) and a maximum value of about 1000 micro Siemens above the conductivity value of the incoming or available water or source water).

Because the fluid that is discharged from modules 9 and 10 through valves 63 and 64 enters extractor reuse tank 24, the conductivity sensor 27 in tank 24 monitors the conductivity of the tunnel washer modules 9 and 10. Valve 63 feeds flow line 65. A tee fitting 67 joins valve 64 with lines 65 and 66 as shown in FIG. 1. The line 66 feeds water to the extractor reuse tank 24 where conductivity is measured by sensor 27.

Pump 58 discharges water from extractor reuse tank 24 and transmits that water via line 68 to the pulse flow tank 26. Valves can be provided at 60, 34 in flow line 68. A drain can be provided in the form of valve 61 as shown in FIG. 1 for discharging directly to a sewer 62 or other suitable drain. A valve 59 is provided for discharging water directly from extractor reuse tank 24 if desired.

Water in pulse flow tank 26 is monitored for conductivity using conductivity sensor 28. The conductivity of water in tank 26 can be monitored and adjusted by introducing water from an outside source 79 and/or 80 through flow line 30 and meter 31. Conductivity sensor 29 monitors the conductivity of water in flow line 30 before it reaches pulse flow tank 26. Additionally, the water in tank 26 is also monitored for conductivity by sensor 28. Flow meter 31 and valve 32 can be provided in flow line 30. Water can be discharged from tank 26 to sewer 43 by opening valve 33. Water can also be discharged from tank 26 through flow line 37 using pump 38. Water exiting tank 26 through flow line 37 can be injected into either module 8 or 9 as shown in FIG. 1 using valves 39, 41 or 42.

A plurality of flow meters can be provided in the various flow lines. The flow line 37 can be equipped with a flow meter 40. A flow meter 31 is provided in the influent flow line 30. A flow meter 47 is provided in the flow line 44.

The influent flow line 30 provides a valve 32. The influent flow line 30 provides make up water as needed for the pulse flow tank 26. The module 10 can be a standing bath. The module 9 can be a standing bath or wash module.

Flow line 35 and pump 69 in FIG. 1 enable water to be transferred from pulse flow tank 26 to module 10. Flow line 35 can be provided with valve 36. Flow line 44 transfers water from module 5 to module 4. Flow line 44 can be provided with pump 45, valve 46 and flow meter 47. Flow line 48 enables water to be transferred from module 1 through pump 49 into hopper 14. In this fashion, soiled laundry or other textile articles added to hopper 14 are immediately wetted with a fast moving stream of water while entering module 1. This function allows the washing process to start in module 1 whereas previous practice module 1 was used only to wet the linen. Flow line 50 enables fresh water to be added directly to module 10. Influent flow line 50 can be provided with flow meter 51 and tee fitting 52. Tee fitting 52 enables fresh water to be transferred to either flow line 53 or 54, each equipped with a valve 55 or 56 as shown. In this fashion, fresh water can be added to either module 9 or 10 in order to adjust conductivity of the water in those modules 9 and 10 to a selected range. A tee fitting 71 can be provided in flow line 35 for adding water directly to hopper 14. The tee fitting 71 enables water to enter hopper 14 through flow line 72 which is equipped with valve 57 and flow meter 70.

Figure 3:
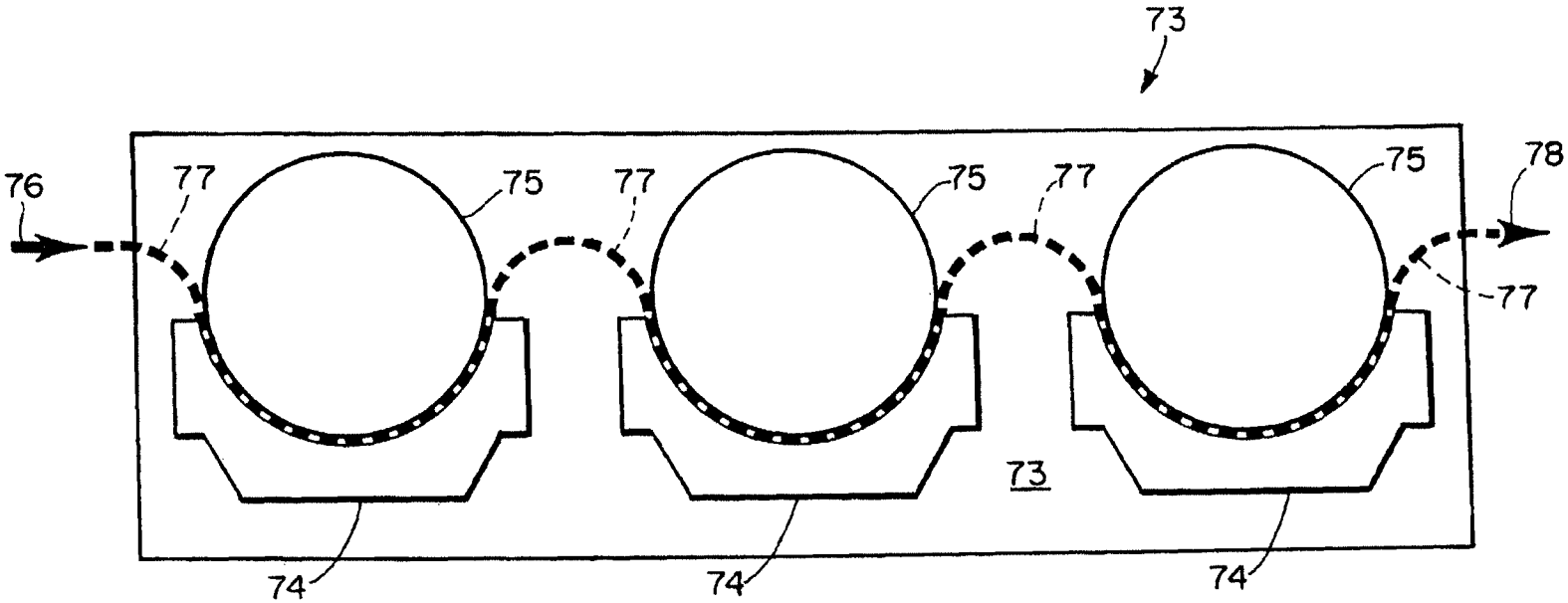
FIG. 3 is a fragmentary view of a preferred embodiment of the apparatus of the present invention illustrating the ironer rolls for demonstrating that without proper rinsing the linen can stick to the chest portion of the ironer roll.

FIG. 3 shows an ironer that is designated generally by the numeral 73. Ironer 73 can include multiple rolls or rollers 75, each supported upon a chest 74. In the prior art, linen sheets or other fabric articles 25 could stick to the chest 74 without proper rinsing. Further, if the conductivity of the water in the linen sheets or fabric articles 25 was outside a selected range, the linen could stick to any one of the chests 74.

With the present invention, the linen sheets or fabric articles 25 (which are indicated schematically by the dotted line 77) in FIG. 3 are less likely to stick to the chest 74 because conductivity of the water is monitored and held within a selected range of between about 100 micro Siemens (minimum value) and a maximum value of about 1000 micro Siemens above the conductivity value of the incoming or available water or source water. In FIG. 3, the arrow 76 schematically illustrates the intake of linen sheets whereas the arrow 78 indicates schematically the discharge of linen sheets after ironing. The ironer 73 shown in FIG. 3 can be part of the finishing station 23 of FIG. 2.

Figure 4A:
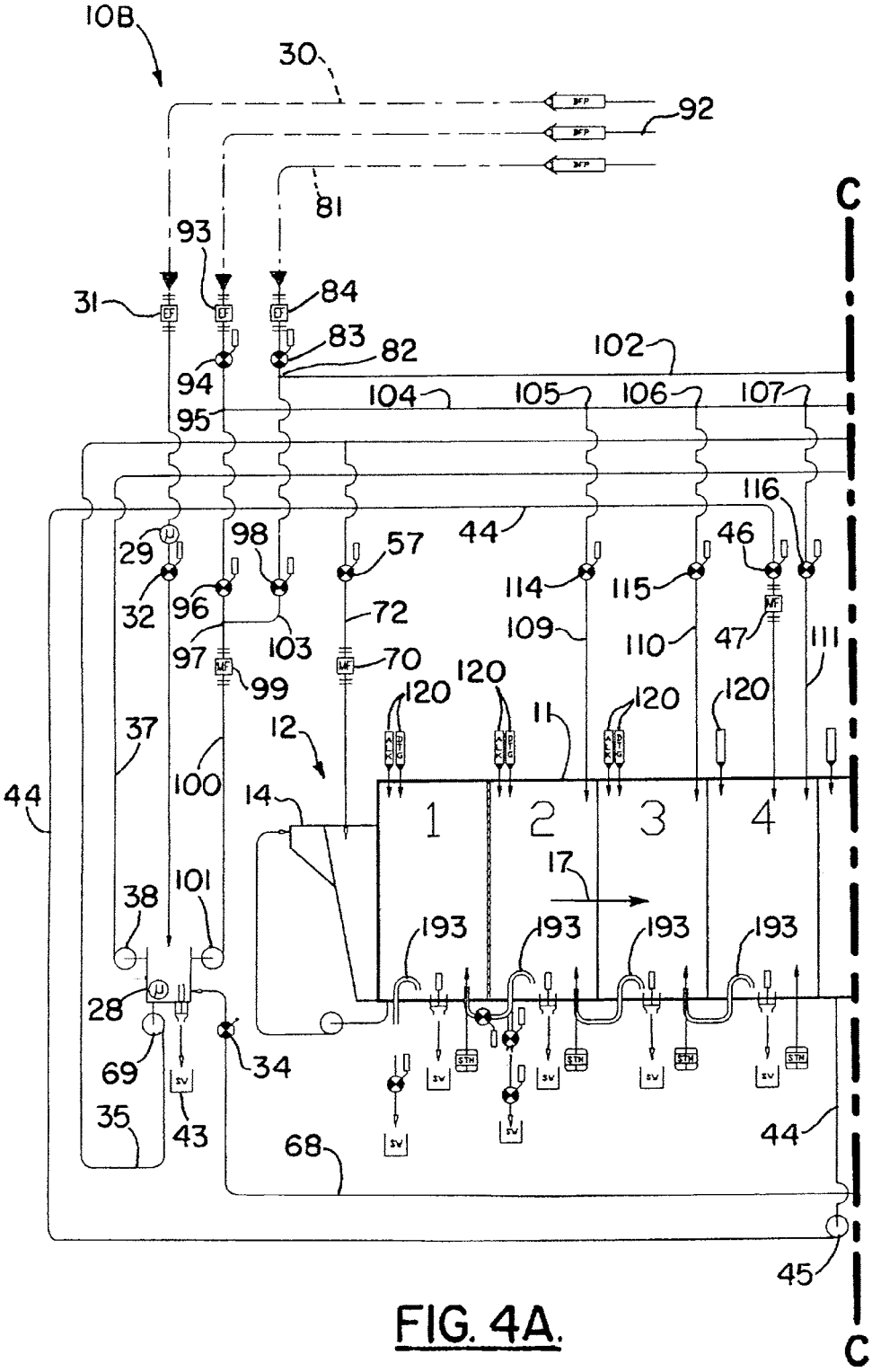
FIG. 4 is comprised of half FIGS. 4A-4B that connect at match lines C-C, providing a diagram of an alternate embodiment of the apparatus of the present invention.
Figure 4B:
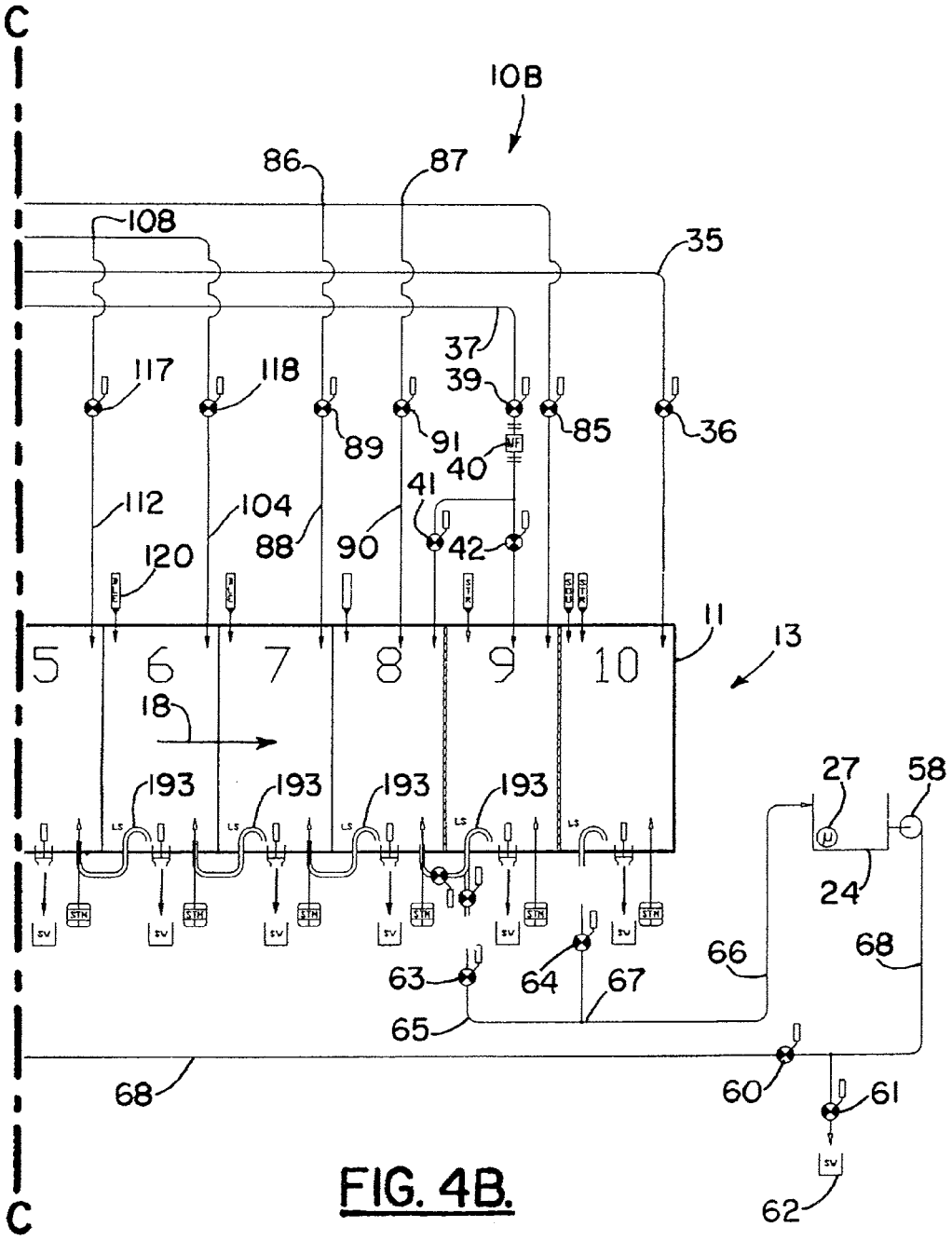
Figure 5:
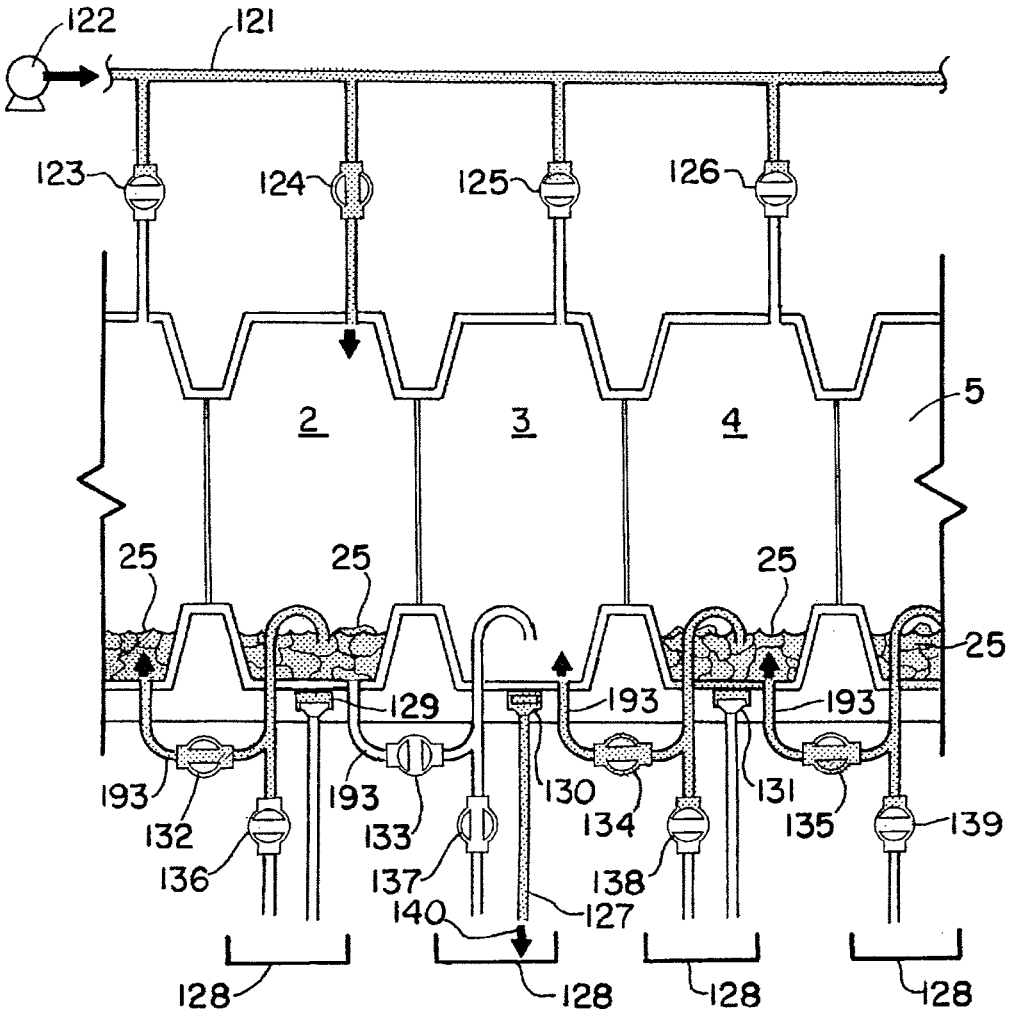
FIG. 5 is a fragmentary view of the alternate embodiment of the apparatus of the present invention.

FIGS. 4-5 show an alternate embodiment of the apparatus of the present invention designated as 10B. It should be understood that FIG. 4 includes half FIGS. 4A-4B that assemble at match lines C-C. As with the embodiment of FIGS. 1-3, textile washing apparatus 10B provides a tunnel washer 11 having a plurality of modules or stations (e.g., between 1 and 32 stations or modules) 1, 2, 3, 4, 5, 6, 7, 8, 9, 10, inlet end portion 12, outlet end portion 13 and discharge 15. The apparatus 10B can employ the press/extractor 19, shuttle 20, dryer 21, transport 22 and finishing station 23 of FIG. 2 and the ironer 73 arrangement of FIG. 3.

Fabric or textile articles 25 to be cleaned are added to hopper 14 at inlet end portion 12. Fabric or textile articles 25 to be cleaned are moved generally in the direction of arrows 17, 18 in FIG. 4. In FIGS. 4-5, an "empty pocket" is provided in a selected module 1, 2, 3, 4, 5, 6, 7, 8, 9 or 10. For example, the empty pocket can initially be module 1, the first module that is next to the inlet end portion 12. The empty pocket then moves in sequence to the second module 2, then to the third module 3, then to modules 4, 5, 6, 7, 8, 9 and finally module 10. This "empty pocket" module typically has no linen. Notice in FIG. 5 that the empty pocket with no linen is module 3. The empty pocket module is created by allowing a transfer of linen from one module to the next for all modules other than the empty pocket module.

For the empty pocket module, no linen is put into the first empty pocket module 1. On the next transfer of linen from each module to the next module, the empty pocket module is now module 2. It is possible to have more than one empty pocket module by means of programming the controller. This "empty pocket" module arrangement minimizes the time out of range conductivity by about forty to fifty percent (40-50%). With the alternate method and apparatus of FIGS. 4-5, as few as two to six transfers are needed to clear a conductivity error compared to between ten and twenty transfers required for a comparable tunnel washer that does not employ this "empty pocket" module arrangement of FIGS. 4-5.

As with the preferred embodiment of FIGS. 1-3, textile washing apparatus 10B can employ conductivity sensors 27, 28, 29. Many of the flow lines, valves, fittings and components of FIG. 1 can be seen in FIG. 4. In FIG. 5, water header 121 is supplied with water from tank 26 with an alternate pump 122. Module 2 receives water through fill valve 124 during a "pulse flow" portion of the cycle. The overall cycle sequence is comprised of three functions: (1) standing bath, which can be about 75% of the cycle; (2) "pulse flow" (high speed or high flow rate rinsing), which can be about 24% of the cycle; and (3) transfer (movement of the linen from one module to the next module, e.g., module 1 to module 2), which can be about 1% of the cycle.

"Pulse flow" is a high velocity rinsing step. Flow line 121 is a simplified representation of the headers shown in FIG. 4A. Pump 101 (the alternative pulse flow pump) supplies water to header 102 or header 104. In FIG. 5, flow line 121 represents either of these headers 102, 104. The empty pocket separates heavily lint fabric articles (e.g., bar towels) from different fabric articles (e.g., table linen). Although valve 124 remains open during the pulse flow portion of the cycle, no water flows because the alternate pulse flow pump 122 is turned off. Fill valves 123, 125 and 126 are closed. Water counterflows from module 4 to module 3 via a counterflow flow line 193 and through open valve 134. However, this water goes immediately to sewer 128 via flow line 127 (see arrow 140, FIG. 5) and open drain valve 130. Module 3 (the empty pocket module) remains empty of water. The valve conditions shown in FIG. 5 accompany an empty pocket of module 3. This valve condition moves with the "empty pocket" as it moves from one module to the next module through the tunnel washer 11 in the direction of arrows 17, 18. In the method and apparatus of FIGS. 4 and 5, the "empty pocket" is first placed in module 1, then moves to module 2, then 3, then to each subsequent module in sequence: 4, 5, 6, 7, 8, 9 until the empty pocket reaches the last module 10. In this case where module 10 is the empty pocket, the controller will signal the receiving apparatus, such as a press or an extractor, that there is no linen in the press or extractor so that it does not cycle.

Counterflow in washer 11 is controlled by the counterflow valves 132, 133, 134, 135. Counterflow is permitted when the valve 133 for flow from module 3 to the previous module 2 is open and the valve 136 for flow to the sewer 128 is closed. Counterflow is prevented when the valve states are opposite. Although counterflow would be possible between module 3 and module 2 in FIG. 5, there is no water available for counterflow as long as drain valve 130 remains open. Any chemical inlets or dispensers 120 on module 3 remain closed during the empty pocket portion of the cycle.

In FIG. 4, flow line 81 connects with Tee-fitting 82 to flow line 102. Line 81 provides valve 83 and flow meter 84. Line 102 provides valve 85. As can be seen in FIG. 4, line 102 discharges into module 9. Tee-fittings are provided at 86, 87 and flow line 102. Line 88 connects with flow line 102 at Tee-fitting 86. Line 88 provides valve 89 and discharges into module 7. Line 90 joins line 102 at Tee-fitting 87. Line 90 provides valve 91 and discharges into module 8. Flow line 92 has flow meter 93 and valve 94. Tee-fitting 95 joins flow line 92 with flow line 104. Line 92 has valve 96, Tee-fitting 97 and flow meter 99. Line 103 joins line 92 at Tee-fitting 97. Below Tee-fitting 97, line 92 is designated as 100 and connects with pump 101 that communicates with tank 26. Flow line 81 has valve 98 and is designated as line 103 below Tee-fitting 102, joining with line 100 at fitting 97. Flow line 104 joins to line 92 at Tee-fitting 95. Tee-fittings 105, 106, 107 and 108 are provided in flow line 104. Line 109 connects to Tee-fitting 105. Line 110 connects to Tee-fitting 106. Line 111 connects to line 104 at Tee-fitting 107. Line 112 connects to line 102 at Tee-fitting 108. Flow line 109 has valve 114. Flow line 110 has valve 115. Flow line 111 has valve 116. Flow line 112 has valve 117. Flow line 104 has valve 118.

Figure 6:
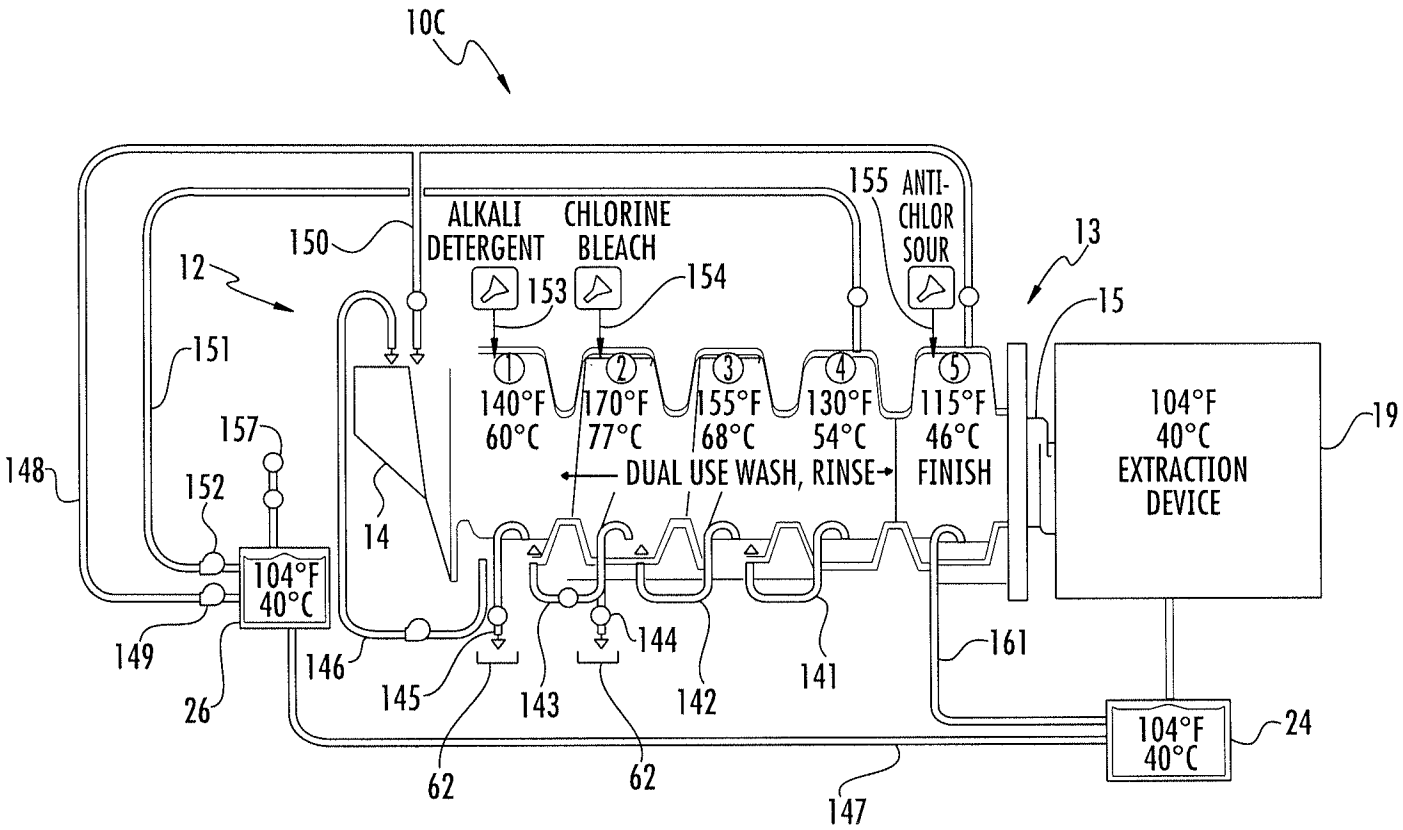
FIG. 6 is a diagram of an alternate embodiment of the apparatus of the present invention showing a five module tunnel washer for use in the hospitality industry and with chlorine bleach.

FIGS. 6-24 show variations of the washing apparatus 10A, 10B of FIGS. 1-5. FIG. 6 shows a five module washing apparatus, designated generally by the numeral 10C. Washing apparatus 10C can be a tunnel washer having modules 1, 2, 3, 4, 5 wherein modules 1, 2, 3, 4 can be dual use modules that perform both wash and rinse functions. Module 5 is a finish module. Washing apparatus 10C has an inlet end portion with hopper 14 for intake of laundry or textile articles or linens and a discharge end portion that discharges fabric articles, linens, laundry to an extraction device 19 (e.g., press or centrifuge). As with the embodiments of FIGS. 1-5, FIGS. 6-24 can provide counterflow flow lines for counterflowing fluid from a downstream module (e.g., module 4) to an upstream module (e.g., module 3).

FIG. 6 is an example of an apparatus having particular utility for the hospitality sector of business. Line 141 is a counterflow line from module 4 to module 3. Line 142 is a counterflow line from module 3 to module 2. Line 143 is a counterflow line from module 2 to module 1. Lines 144, 145 and valved drain lines to sewer 128. Line 146 is a valved recirculation line to hopper 14. As with FIGS. 1-5, FIG. 6 employs tanks 24, 26. Flow line 161 drains module 5 to tank 24. Line 147 transmits fluid from tank 24 to tank 26. Flow line 148 has pump 149 and transmits fluid from tank 26 to module 5 and/or hopper 14 via branch line 150. Line 151 and pump 152 transmit fluid from tank 26 to module 4. Alkali detergent at 153 is shown for addition to module 1. Chlorine bleach is shown at 154 for addition to module 2. Antichlor sour solution is shown at 155 for addition to module 5.

Figure 7:
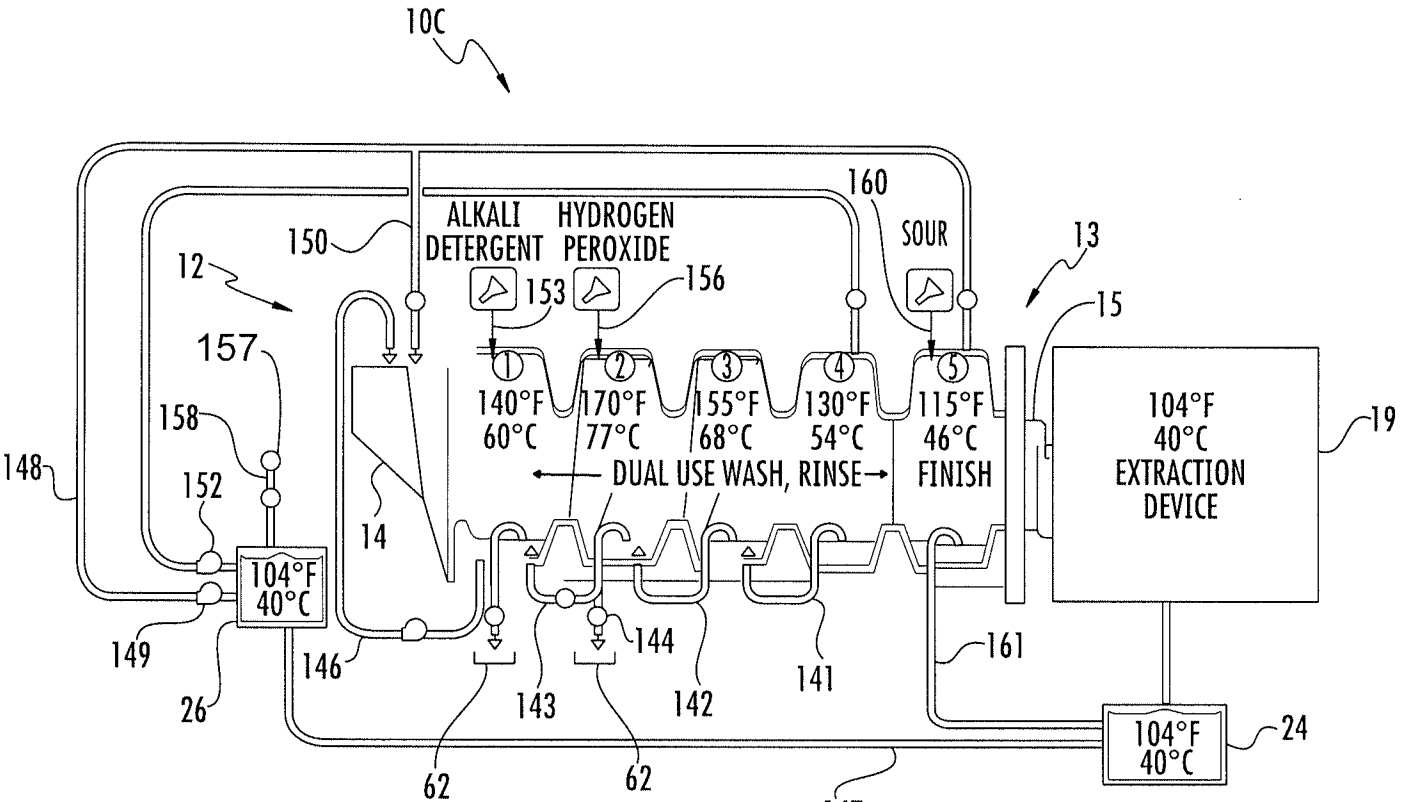
FIG. 7 is a diagram of an alternate embodiment of the apparatus of the present invention showing a five module tunnel washer for use in the hospitality industry and with hydrogen peroxide.
Figure 8:
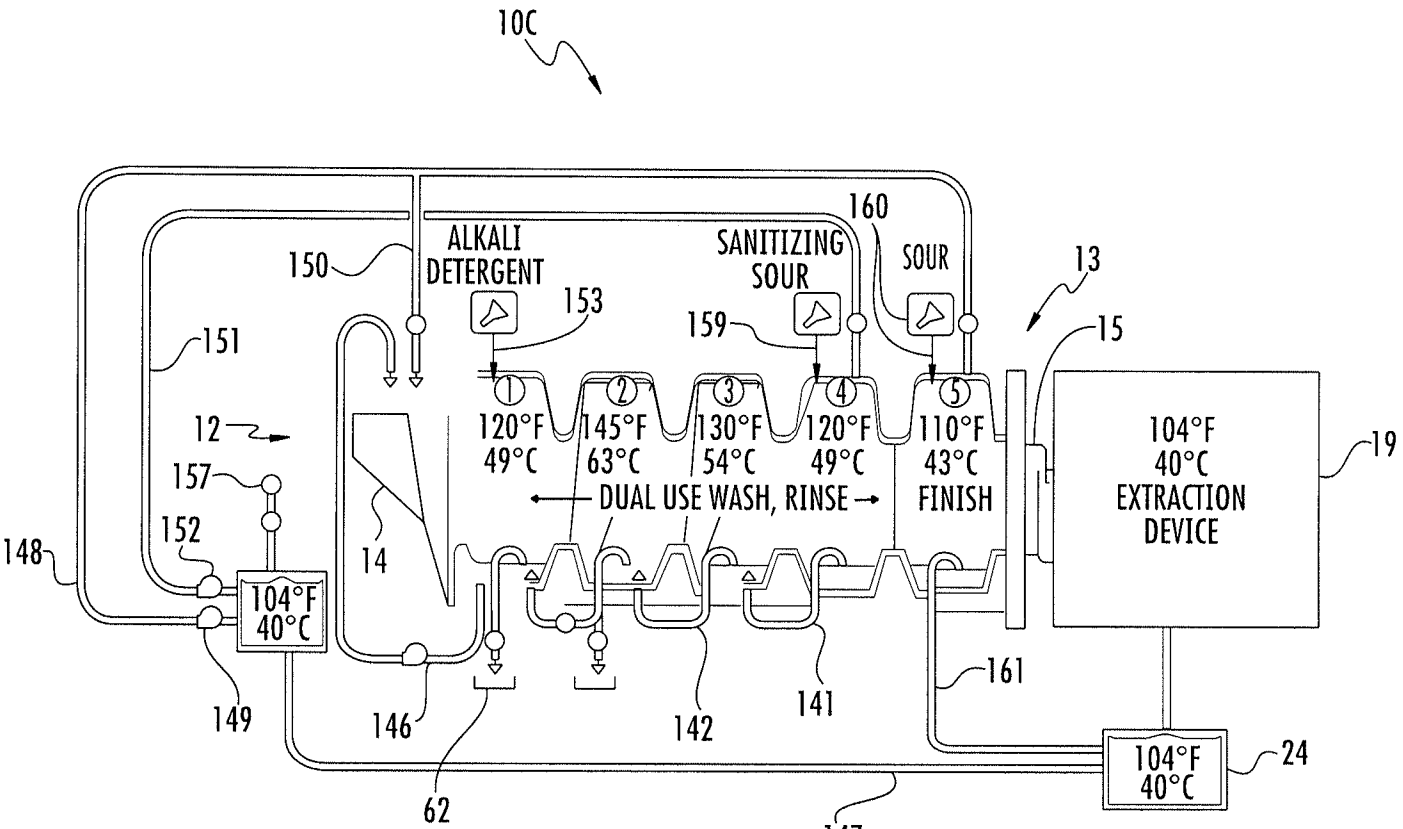
FIG. 8 is a diagram of an alternate embodiment of the apparatus of the present invention showing a five module tunnel washer for use in the hospitality industry and with sanitizing sour.

For exemplary parameters of FIG. 6, total time is 17.5 minutes. Transfer time of fabric articles, linens, laundry from one module to the next module (e.g., module 1 to module 2 or module 2 to module 3, etc.) is 180 minutes. Batches of laundry, linens, fabric articles per time is about 17 batches per hour. Water consumption is 0.3 to 0.4 gallons per pound of laundry (2.5 to 3.3 liters per kilogram of laundry). Average pulse flow water quantity is 105 gallons (or 398 liters) per batch of laundry. In FIG. 7, washer 10C replaces chlorine bleach at 154 with hydrogen peroxide at 156. Water can be added to tank 26 via source 157 and valved flow line 158. In FIG. 8, sanitizing sour at 159 is added to module 4. In FIG. 8, chlorine bleach 154 and hydrogen peroxide 156 are not present.

Figure 9:
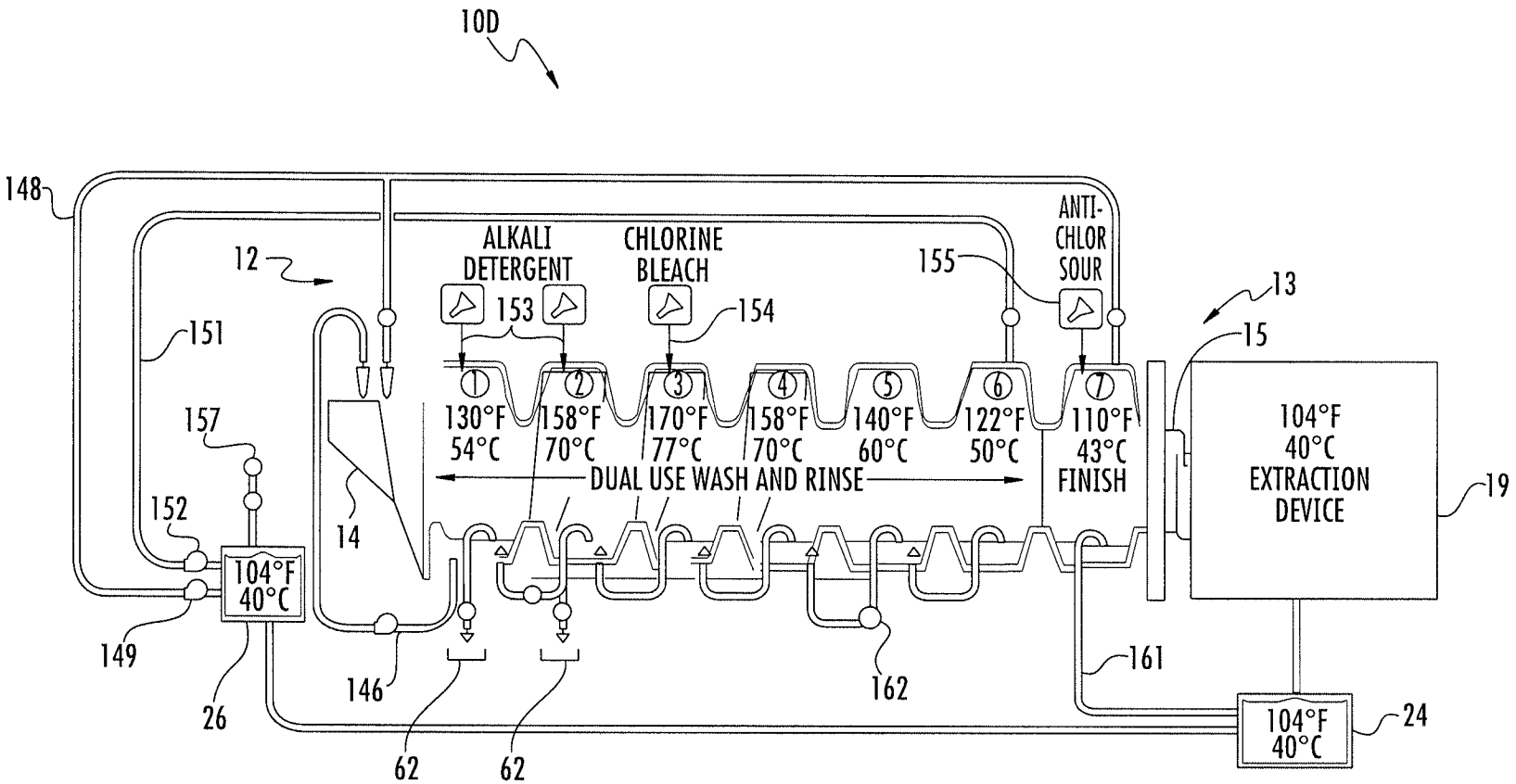
FIG. 9 is a diagram of an alternate embodiment of the apparatus of the present invention showing a seven module tunnel washer for use in the hospitality industry and with chlorine bleach.
Figure 10:
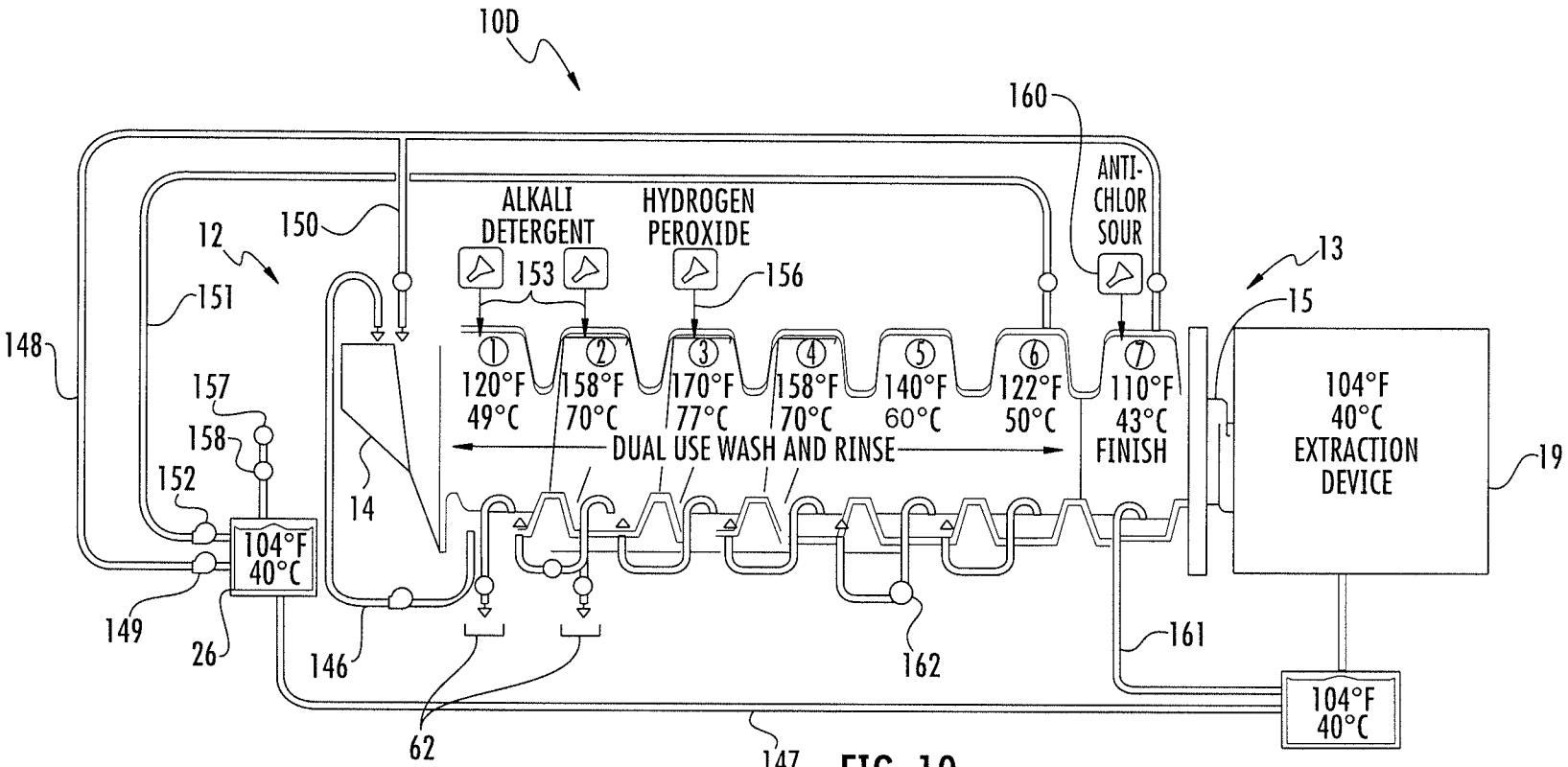
FIG. 10 is a diagram of an alternate embodiment of the apparatus of the present invention showing a seven module tunnel washer for use in the hospitality industry and with hydrogen peroxide.
Figure 11:
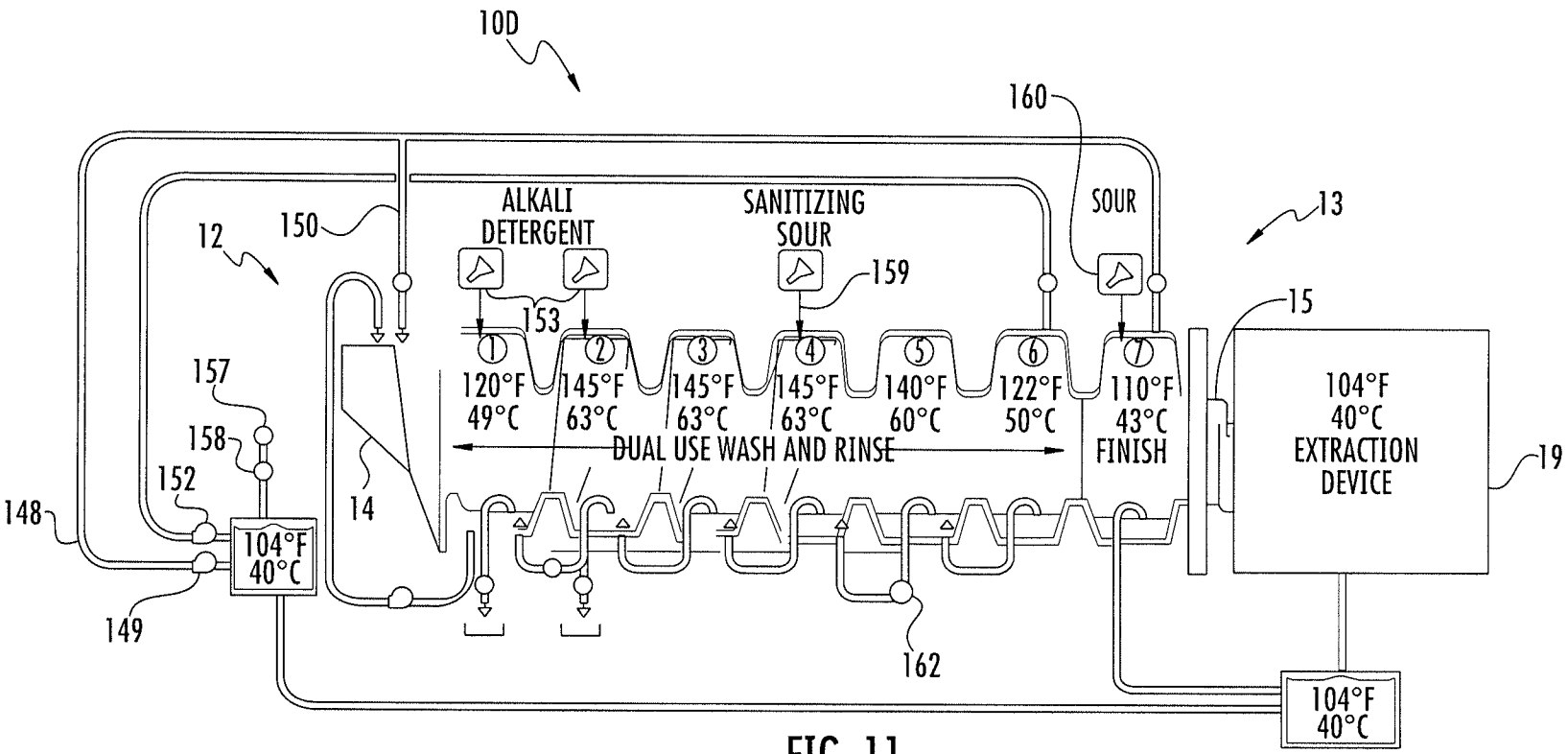
FIG. 11 is a diagram of an alternate embodiment of the apparatus of the present invention showing a seven module tunnel washer for use in the hospitality industry and with sanitizing sour.

FIGS. 9-11 show an arrangement similar to FIGS. 6-8 but for a seven module tunnel washer apparatus 10D wherein alkali detergent 153 is added to modules 1, 2 with chlorine bleach 154 is added to module 3 and antichlor sour 155 to module 7. In FIG. 10, hydrogen peroxide 156 replaces chlorine bleach 154. In FIG. 11, sanitizer sour 160 is added to module 4 and sour solution 161 to module 7 while chlorine bleach and hydrogen peroxide are not present. In FIGS. 9-11, counterflow lines are provided as with FIGS. 1-8. One of the counterflow flow lines can be provided with pump 162. Pump 162 can be in the counterflow flow line that transmits fluid from module 5 to module 4. In FIGS. 9-11, exemplary parameters are 14.6 minutes total time. Transfer time is 129 seconds. Batches per time equals 29 per hour. Water consumption is 0.3 to 0.4 gallons per pound of fabric articles (e.g., linens) or between 2.5-3.3 liters per kilogram. Pulse flow water liquor ratio is about 0.7 gallons per pound or 5.8 liters per kilogram. Average pulse flow water per batch is 105 gallons (397.5 liters).

Figure 12:
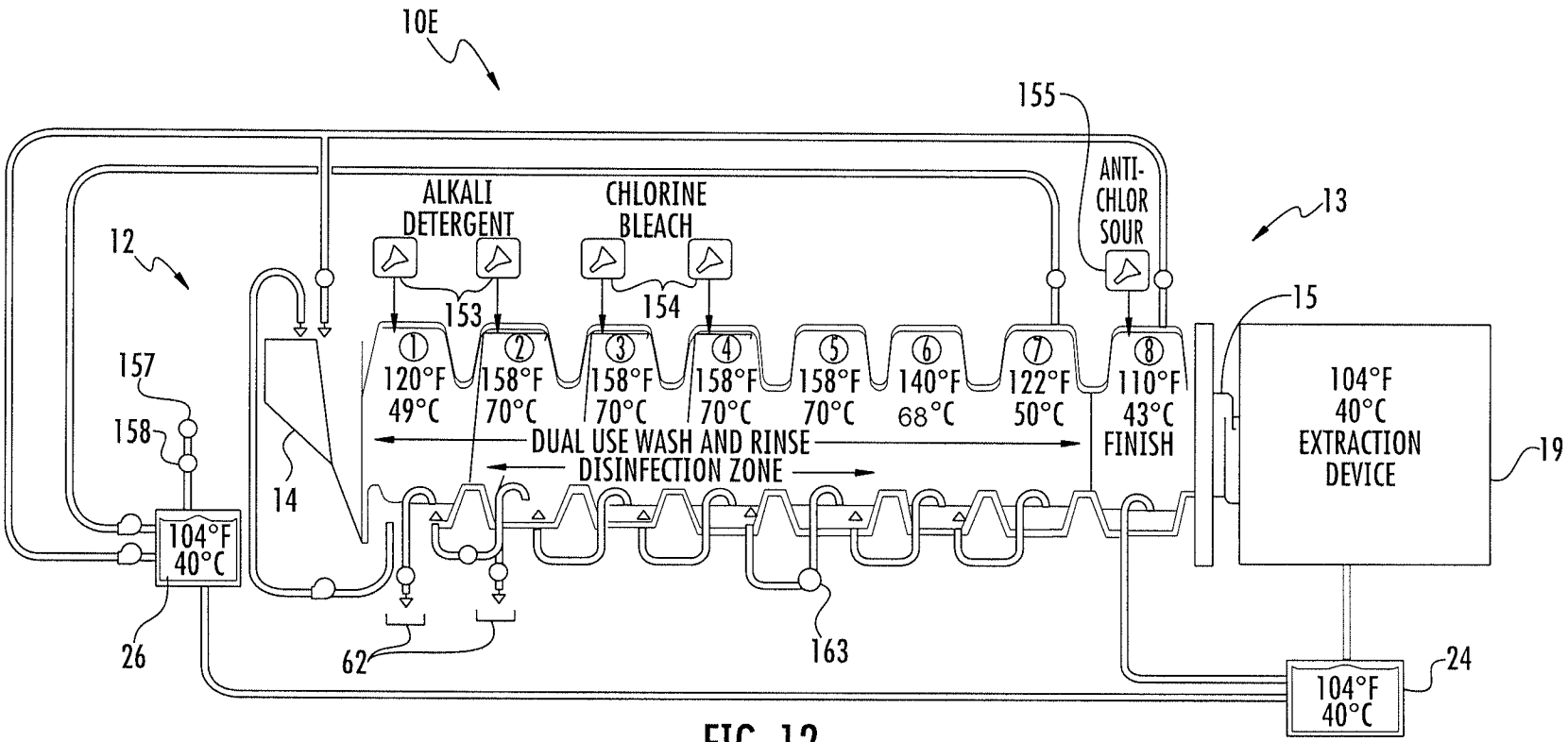
FIG. 12 is a diagram of an alternate embodiment of the apparatus of the present invention showing an eight module tunnel washer for use in the hospitality industry and with chlorine bleach.
Figure 13:
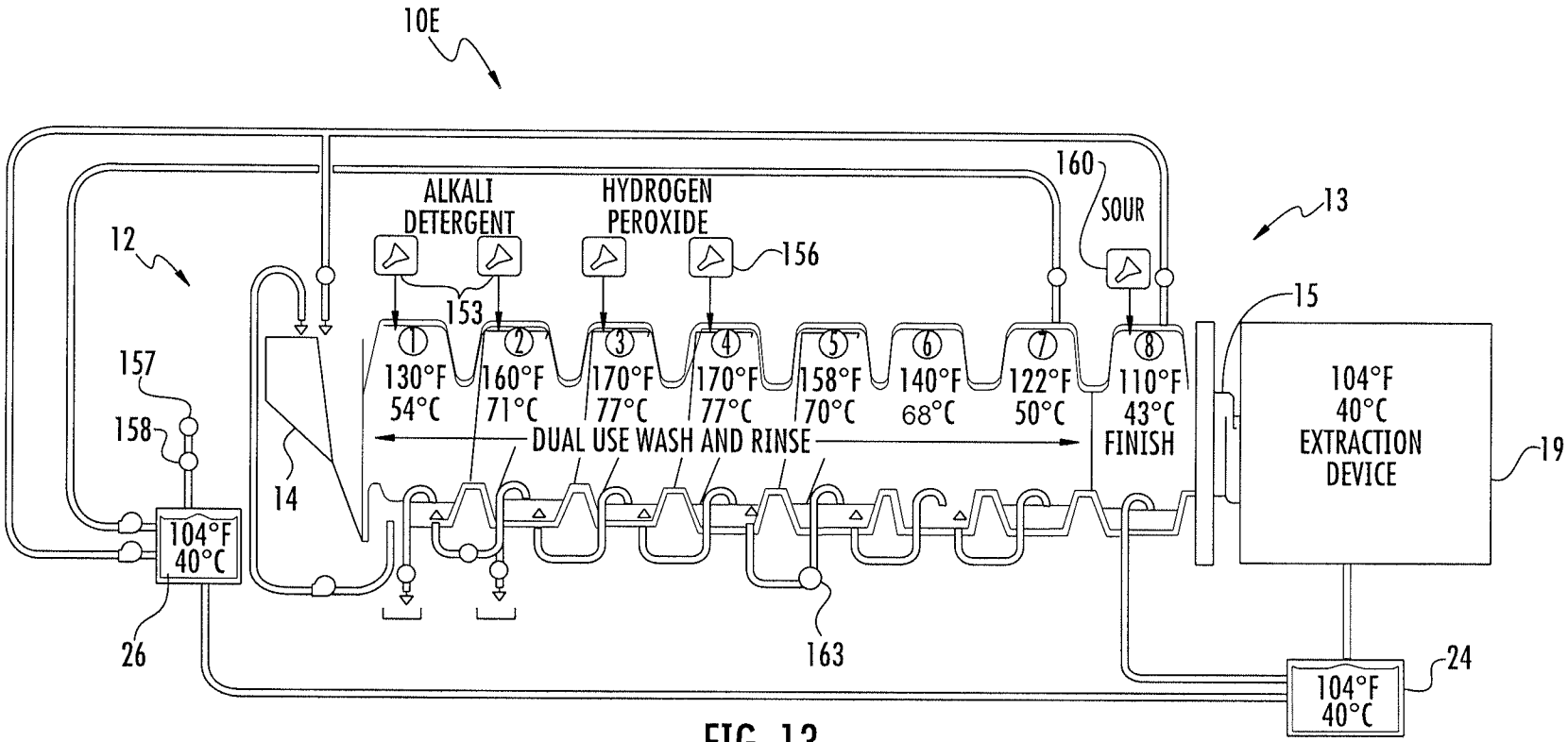
FIG. 13 is a diagram of an alternate embodiment of the apparatus of the present invention showing an eight module tunnel washer for use in the hospitality industry and with hydrogen peroxide.
Figure 14:
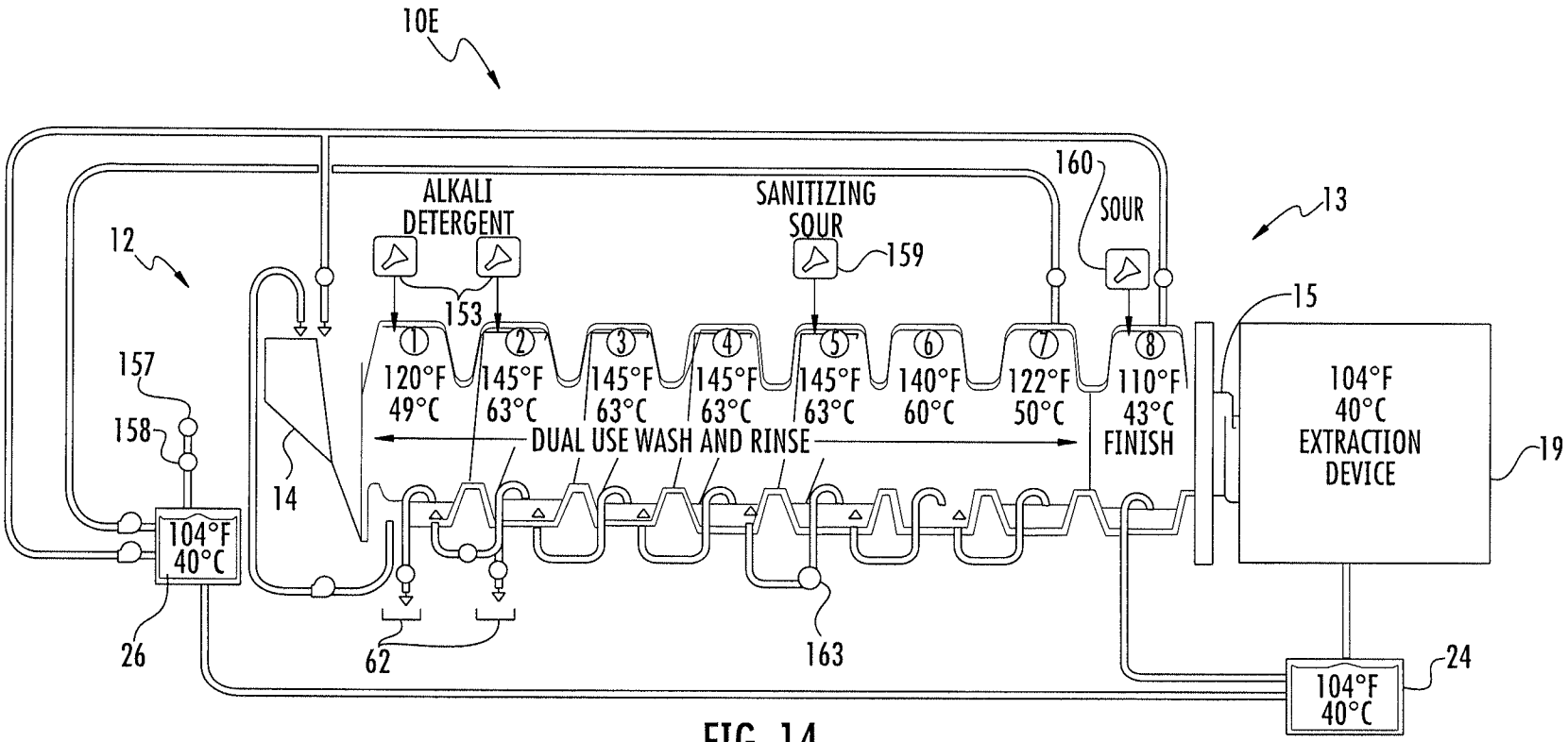
FIG. 14 is a diagram of an alternate embodiment of the apparatus of the present invention showing an eight module tunnel washer for use in the hospitality industry and with sanitizing sour.

FIGS. 12-14 show a washing apparatus similar to FIGS. 6-8, but for an eight module washer 10E. In FIGS. 12-14, alkali detergent 153 is added to modules 1, 2. Chlorine bleach 154 is added to modules 3, 4 and antichlor sour solution 155 to module 8. In FIG. 13, hydrogen peroxide 156 replaces the chlorine bleach 154 of FIG. 12. In FIG. 14, neither chlorine bleach 154 nor hydrogen peroxide 156 are used. Instead, sanitizing sour 159 is added to module 5 and sour solution 160 is added to module 8. In FIGS. 12-14, the counterflow lines are provided as with FIGS. 1-11. One of the counterflow lines can be provided with pump 163. Pump 163 can be in the counterflow line that transmits fluid from module 5 to module 4.

Figure 15:
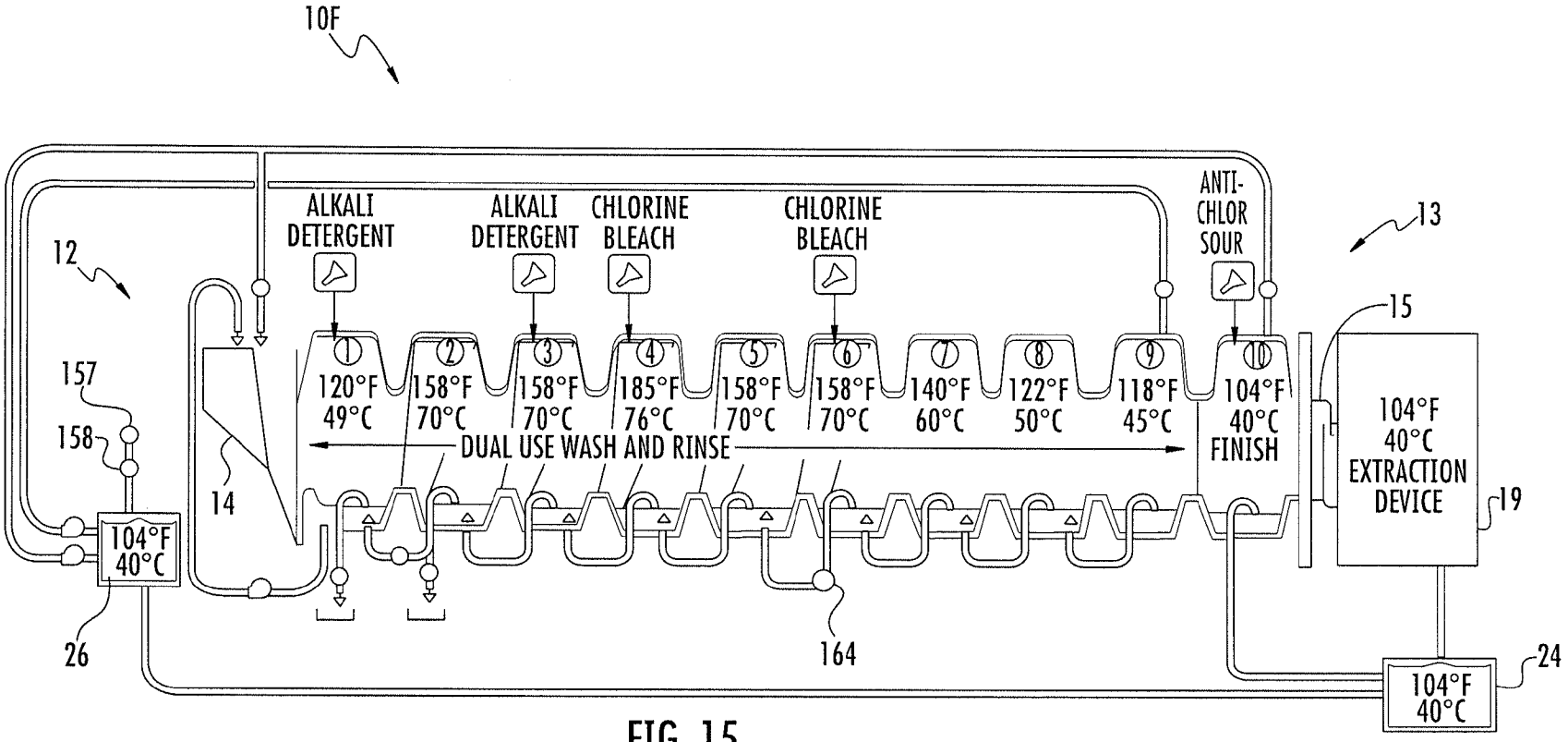
FIG. 15 is a diagram of an alternate embodiment of the apparatus of the present invention showing a ten module tunnel washer for use in the hospitality industry and with chlorine bleach.
Figure 16:
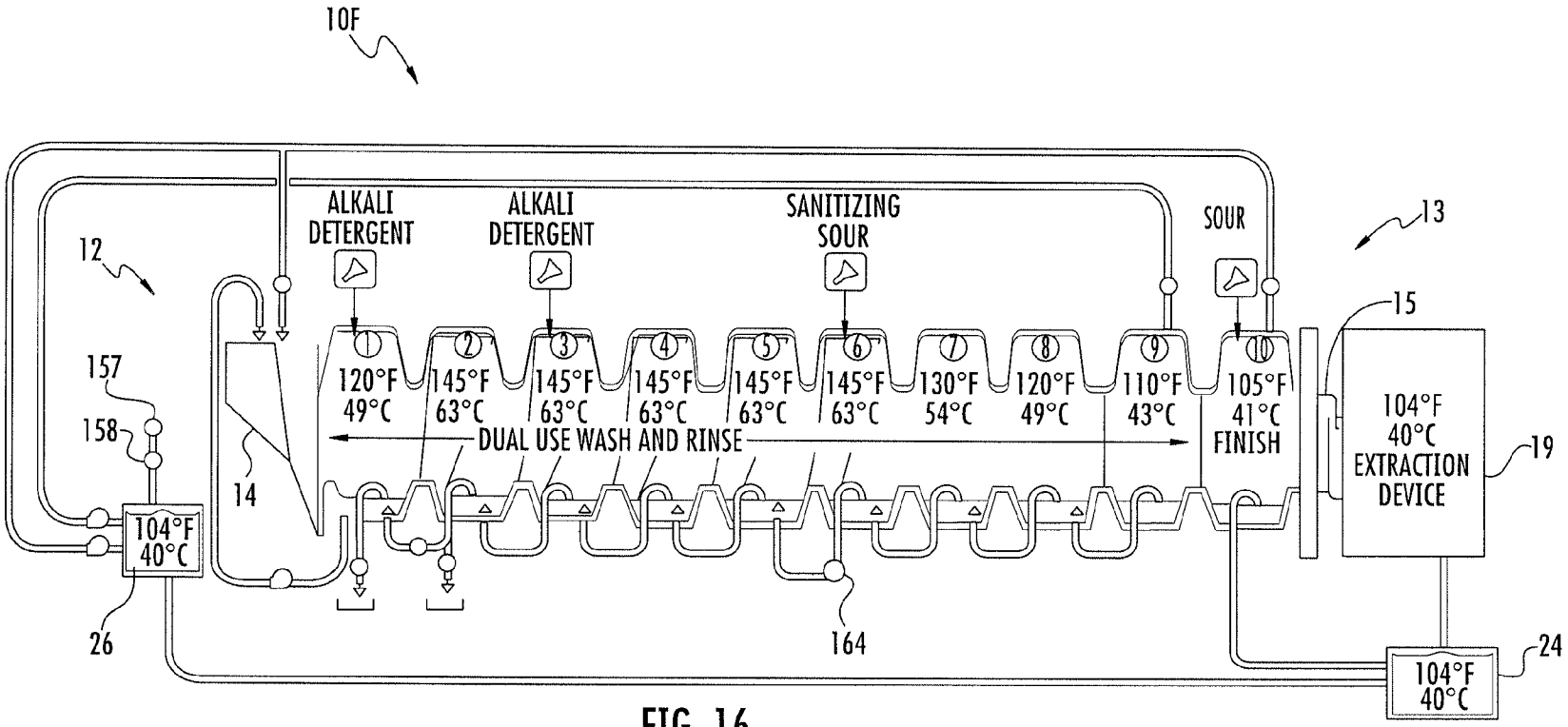
FIG. 16 is a diagram of an alternate embodiment of the apparatus of the present invention showing a ten module tunnel washer for use in the hospitality industry and with sanitizing sour.

FIGS. 15-16 show a ten module washing apparatus 10F wherein pump 164 is in a counterflow line that transmits fluid from module 6 to module 5.

Figure 17:
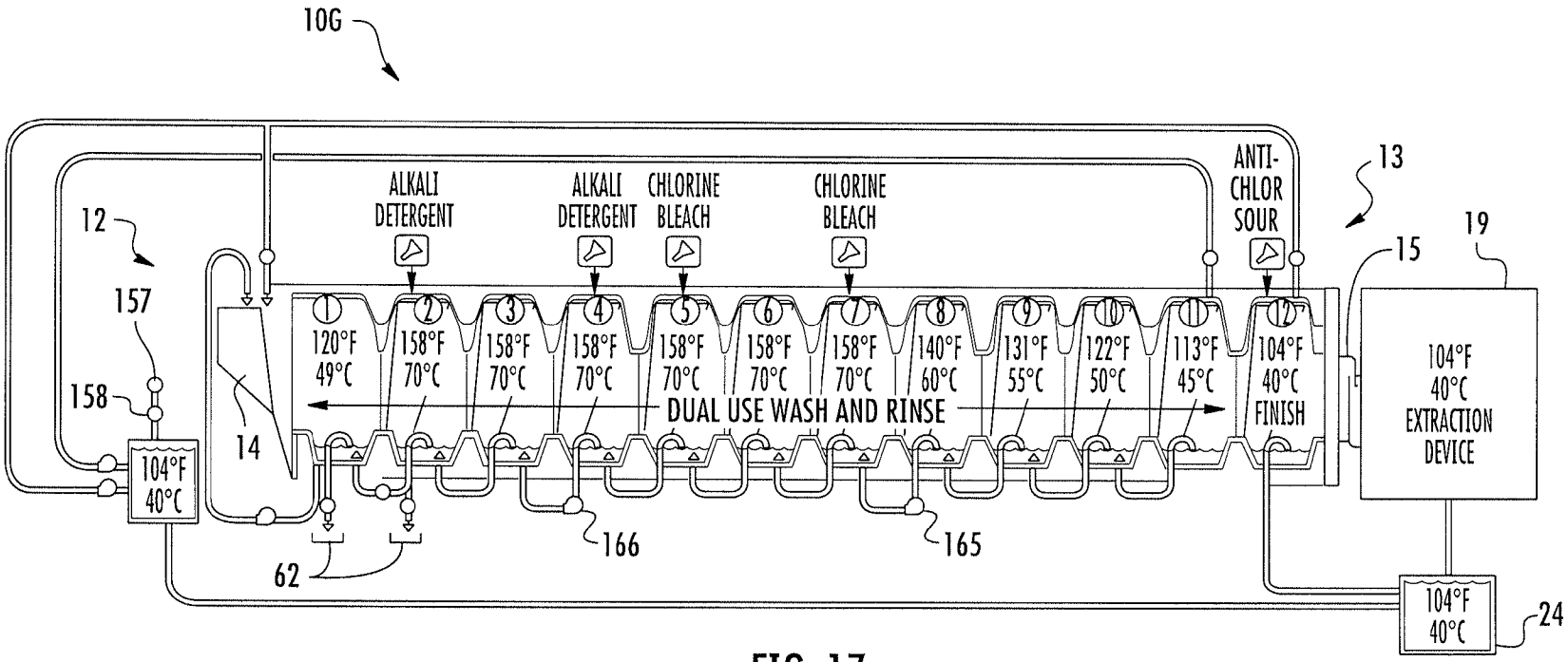
FIG. 17 is a diagram of an alternate embodiment of the apparatus of the present invention showing a twelve module tunnel washer for use in the hospitality industry and with chlorine bleach.
Figure 18:
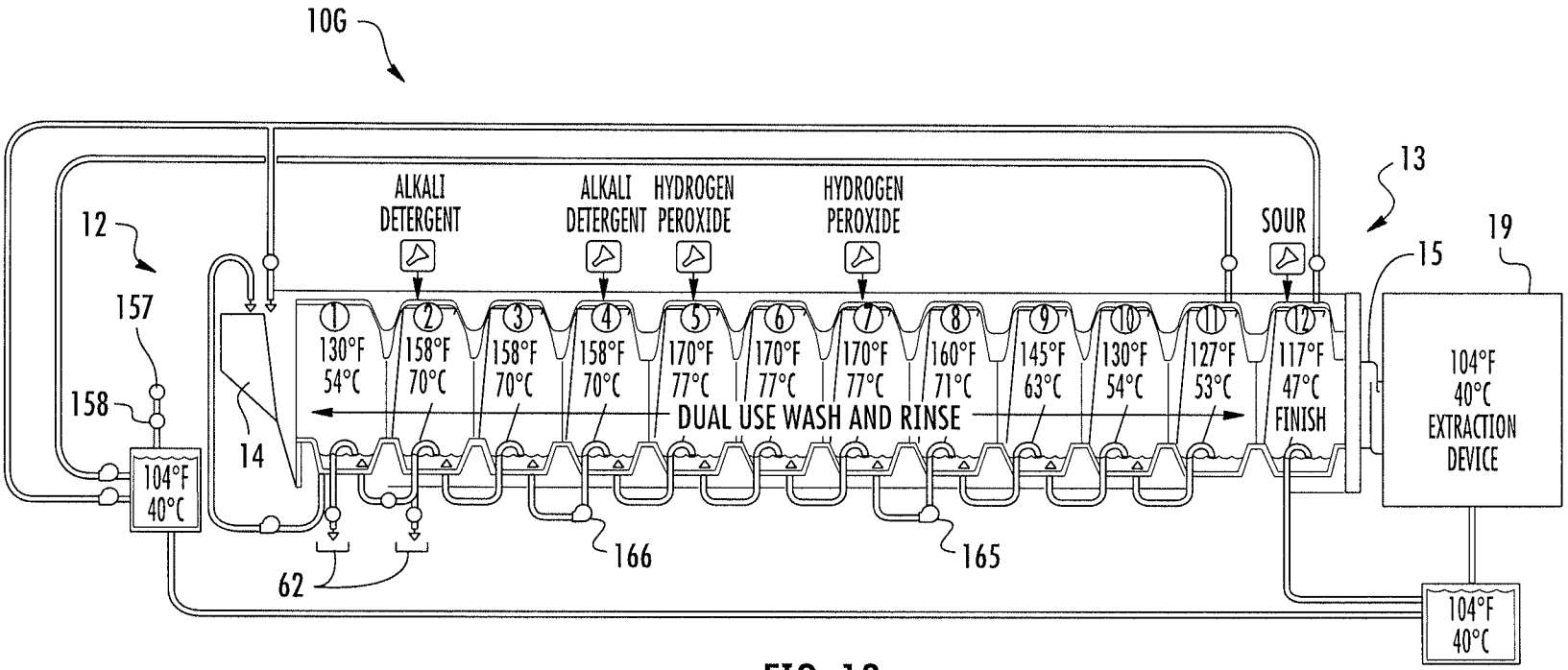
FIG. 18 is a diagram of an alternate embodiment of the apparatus of the present invention showing a twelve module tunnel washer for use in the hospitality industry and with hydrogen peroxide.
Figure 19:
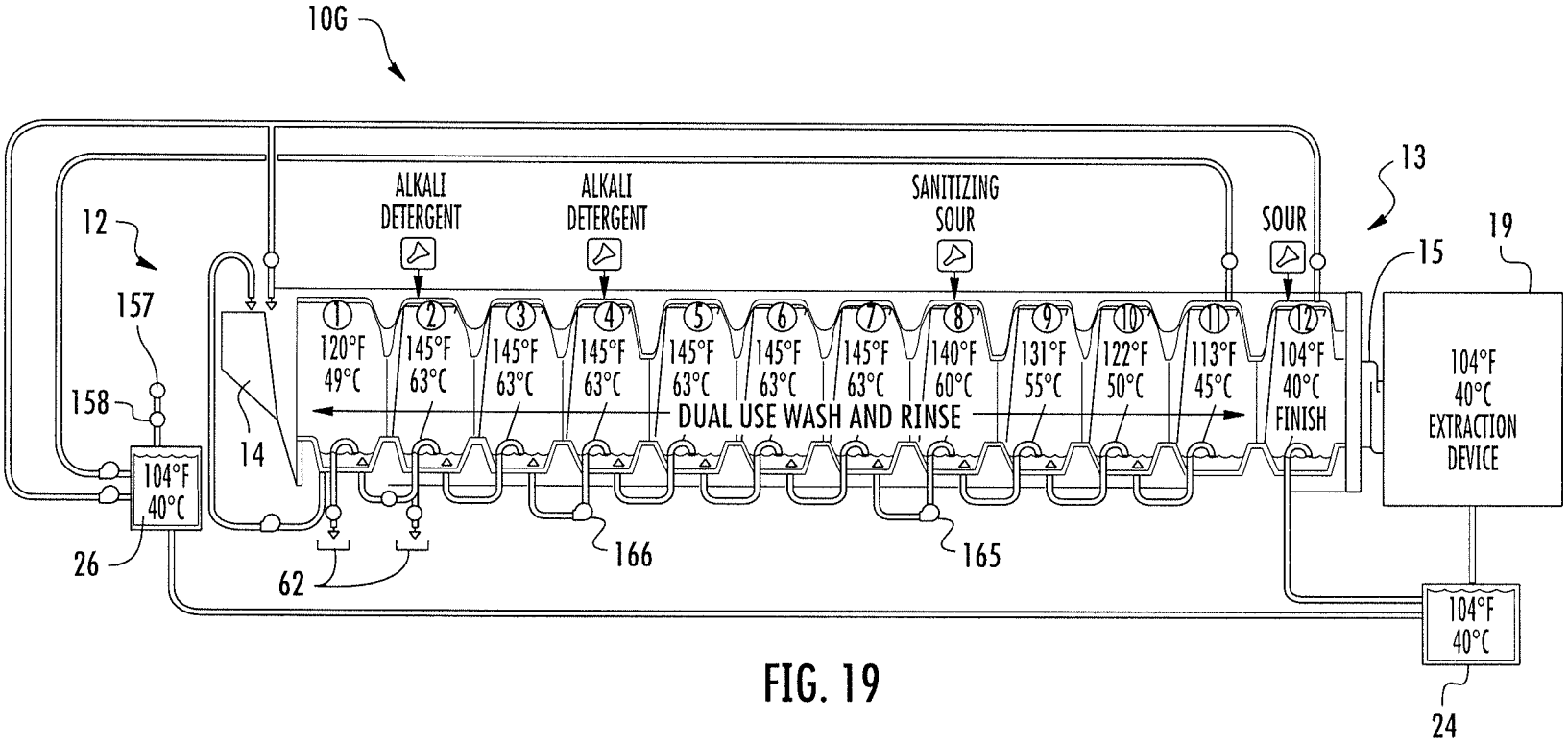
FIG. 19 is a diagram of an alternate embodiment of the apparatus of the present invention showing a twelve module tunnel washer for use in the hospitality industry and with sanitizing sour.

FIGS. 17-19 show a twelve module washing apparatus 10G wherein pump 165 is in a counterflow line from module 8 to module 7. Pump 166 is in a counterflow line from module 4 to module 3.

Figure 20:
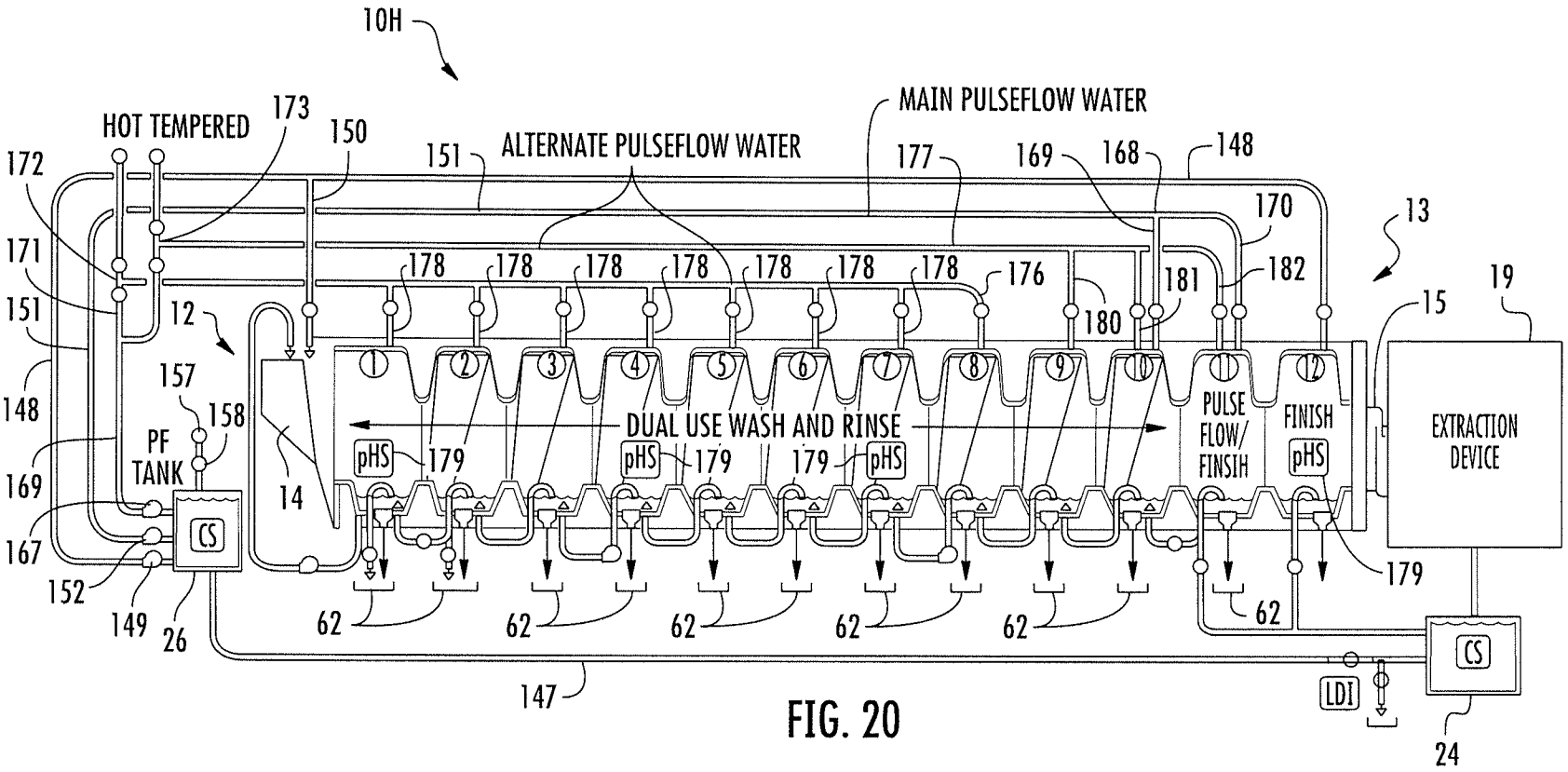
FIG. 20 is a schematic diagram of a preferred embodiment of the apparatus of the present invention showing a twelve module tunnel washer with alternate pulse flow and long distance incompatibility avoidance for incompatible batches.

FIG. 20 shows a twelve module washing apparatus 10H with an alternate pulse flow that uses two or more pulse flow streams and having long distance incompatibility avoidance for incompatible batches, pH sensing and conductivity sensing. In cases of white vs. colored fabric articles separated by empty pocket, an alternate pulse flow can be provided which provides separate streams of counterflow water so that the counterflow for the colored downstream linen does not contact the white linen at the front of the machine.

In FIG. 20, two finish modules 11, 12 are provided for optional starching. In FIG. 20, tank 26 has pumps 149, 152 and a third pump 167. Line 151 branches at tee fitting 168 to lines 169 (discharging to module 8) and line 170 (discharging to module 9). Third pump 167 discharges to line 169 which has tee fittings at 171, 172, 173. Valves are provided on opposing sides of tee fittings 172, 173 so that hot water at 174 or tempered water at 175 can be selectively added to an alternate pulse flow header 176 or 177. Alternate pulse flow header 176 enables water to be added to any one of modules 1, 2, 3, 4, 5, 5, 6, 7 or 8 via a valved branch line 178. As with FIGS. 1-5, each module has a valved drain line and counterflow lines that connect a module (e.g., module 9) to a previous module (e.g., module 8). Line 177 has valved branch lines 180, 181, 182.

An incompatible batch normally refers to a classification of linen which can be a different color than linen in downstream modules. For example, if red table linen is in modules 1 to 10 and the next classification of linen to enter the tunnel is white, the counterflow water used for the red table linen cannot be used for the white linen. Different counterflow streams are thus provided, described herein as "alternate pulse flow". Because the press water extracted from the red table linen normally flows to the PulseFlow tank, this water has to be diverted to sewer using the valves 60 (Closed) and 61 (Open), as seen in FIG. 4B. The programming feature in the controller to operate these valves is called "Long Distance Incompatibility". FIGS. 20-24 all provide such "alternate pulse flow" with multiple sources of counterflow or multiple pulse flow headers.

Figure 21:
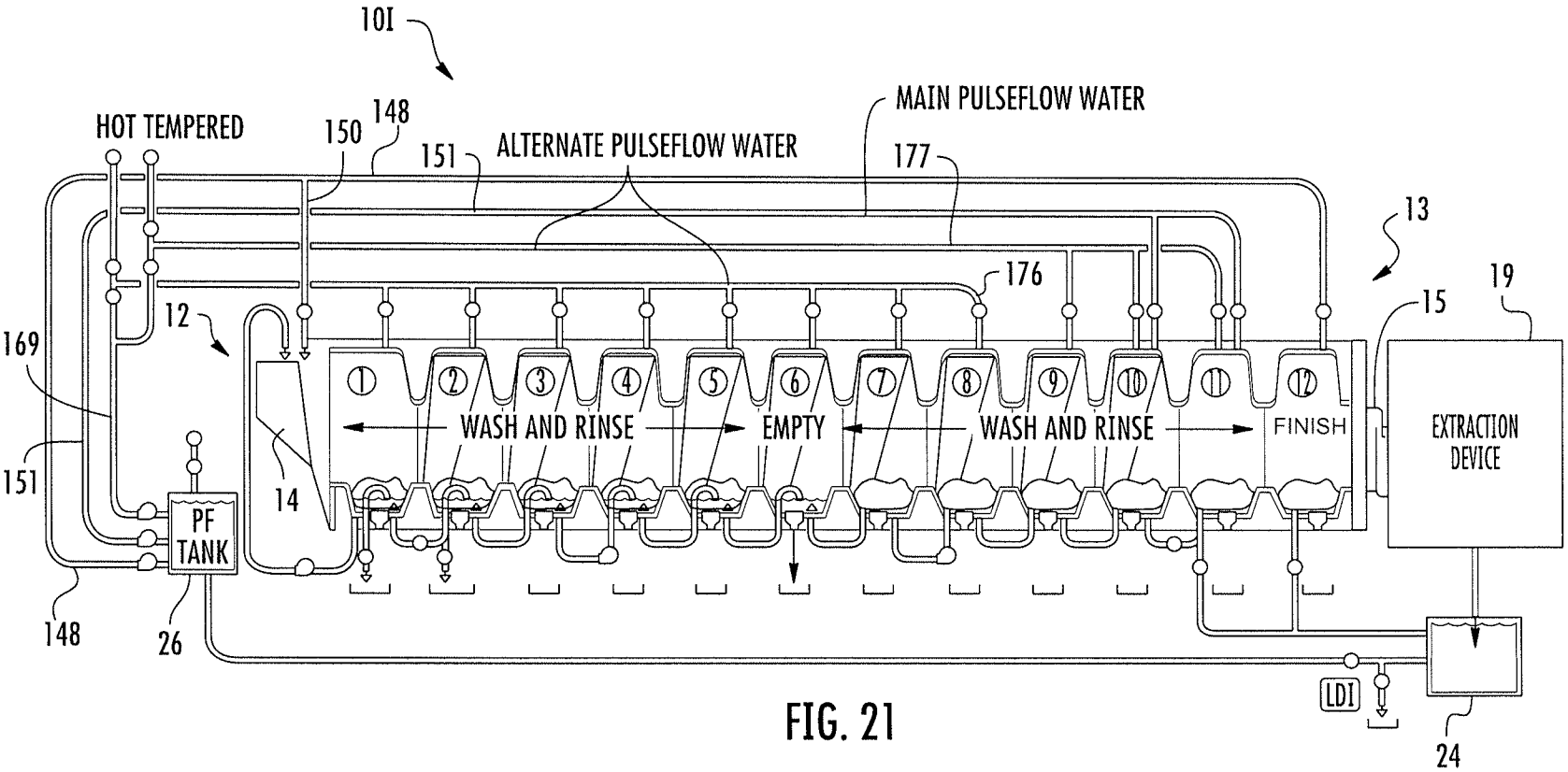
FIG. 21 is a schematic diagram of an alternate embodiment of the apparatus of the present invention having alternate pulse flow and long distance incompatibility avoidance wherein white textile articles follow colored or non-white textile articles.

In FIG. 21, a twelve module washing apparatus 10I provides an example of long distance incompatibility avoidance wherein white linen or textile articles follow colored linen or textile articles, an empty pocket provided at module 6. Colored textile articles or colored linen are in modules 7-12 in FIG. 21. White linen or textile articles are in modules 1-5 in FIG. 21.

FIG. 21 is similar to FIG. 20, but provides an "empty pocket" (at module 6 in FIG. 21) which separates colored fabric articles from white fabric articles.

Figure 22:
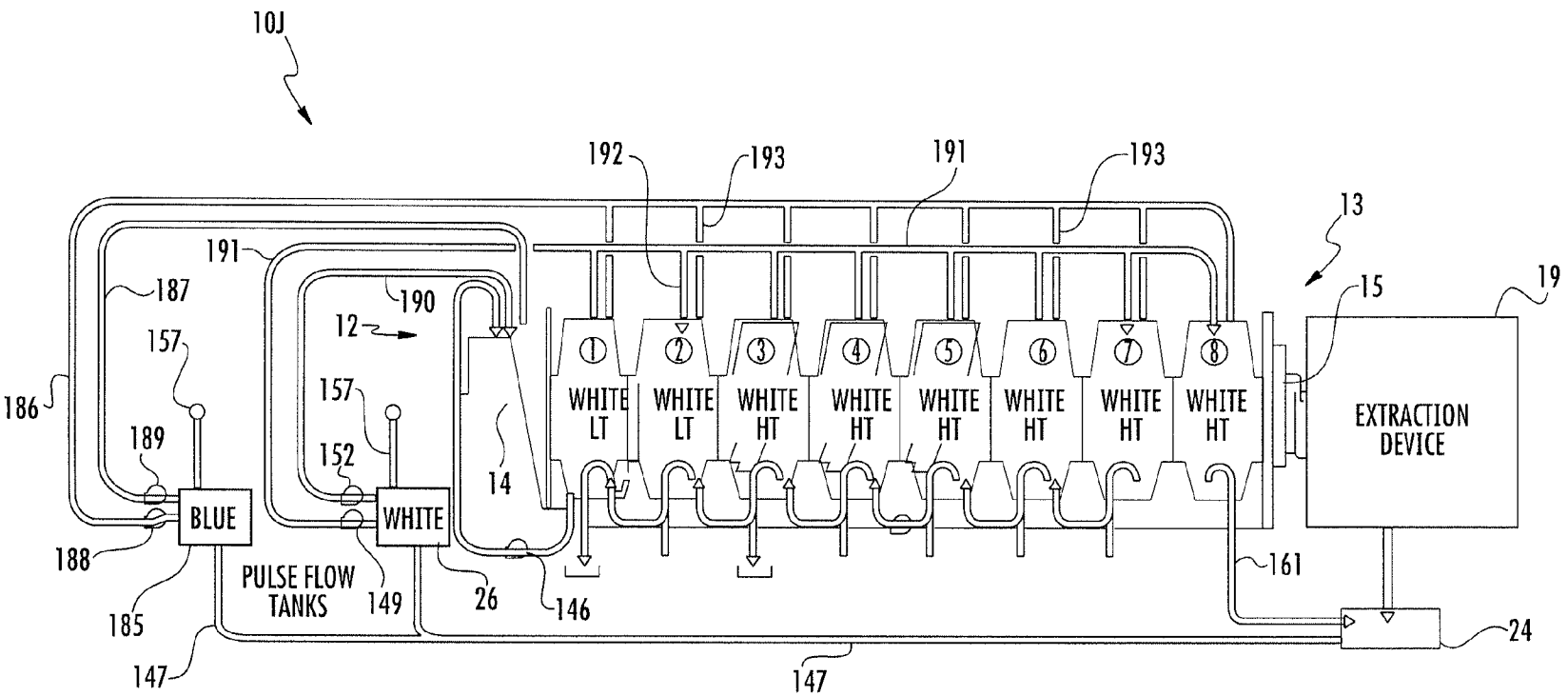
FIG. 22 is a schematic diagram of a preferred embodiment of the apparatus of the present invention showing an eight module tunnel washer with alternate pulse flow and wherein low temperature white fabric articles follow high temperature white fabric articles.

In FIG. 22, washing apparatus 10J provides an eight module washing apparatus wherein low temperature washing follows high temperature washing of white linen or white textile articles. In FIG. 22, modules 1 and 2 are low temperature (e.g., 50° C.). Modules 2-8 are high temperature (e.g. 75° C.).

Figure 23:
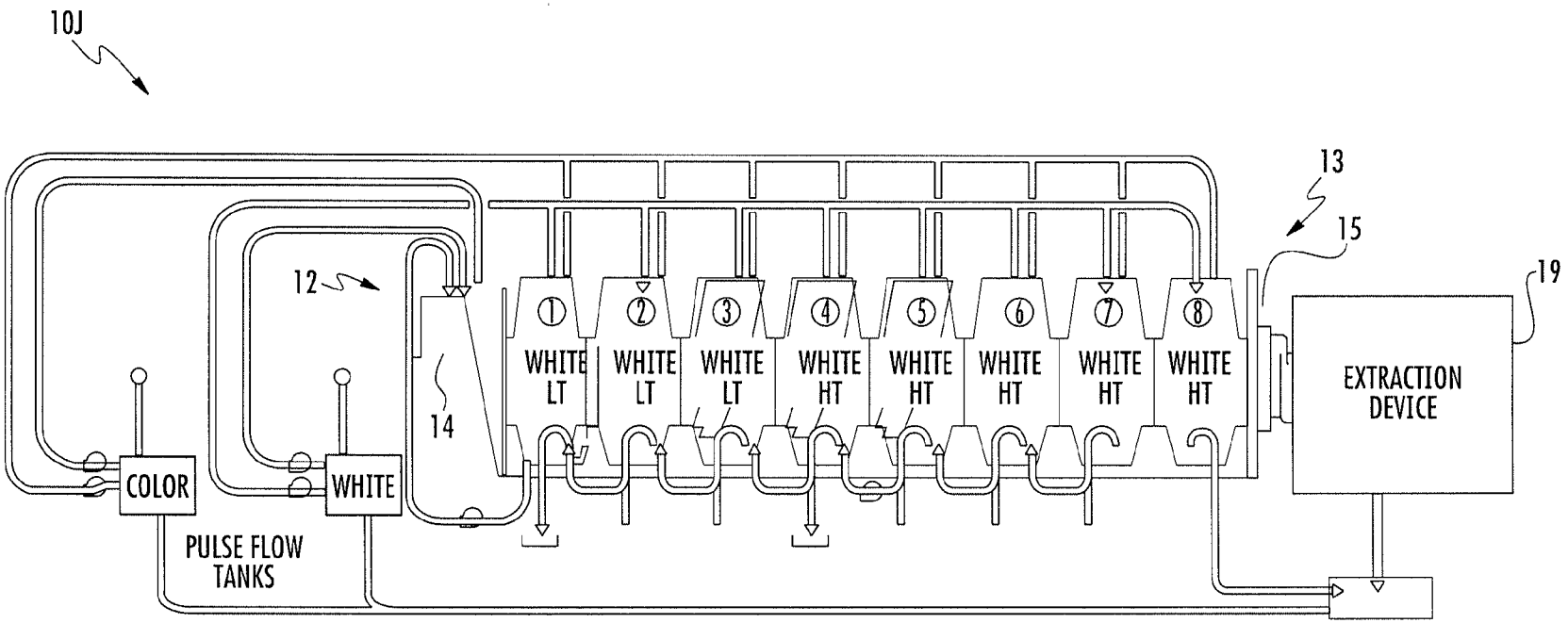
FIG. 23 is a schematic diagram of a preferred embodiment of the apparatus of the present invention showing an eight module tunnel washer with alternate pulse flow and wherein low temperature white fabric articles follow high temperature white fabric articles.
Figure 24:
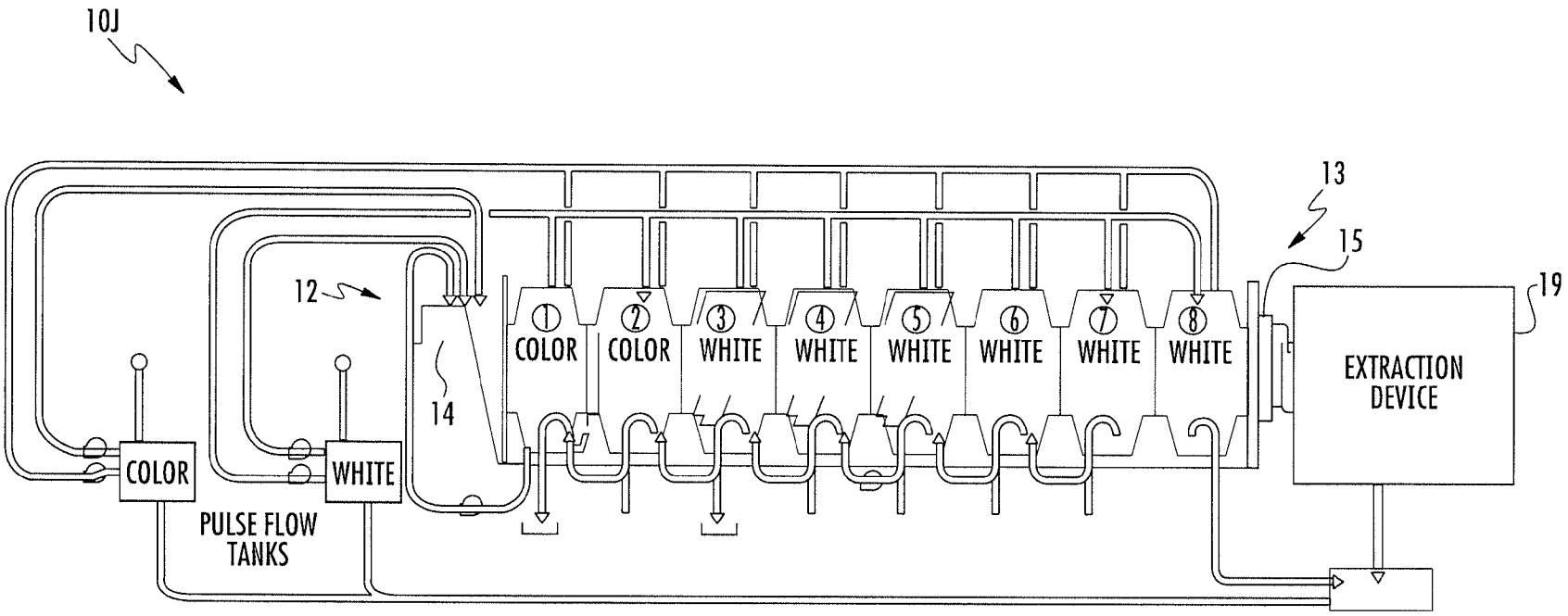
FIG. 24 is a schematic diagram of a preferred embodiment of the apparatus of the present invention showing an eight module tunnel washer with alternate pulse flow and wherein color fabric articles follow white fabric articles.

In FIG. 23, modules 1-3 are low temperature white linen or textile articles wherein modules 4-8 are high temperature white linen or textile articles. In FIG. 24, colored linen articles in modules 1-2 follow white linen articles in modules 3-8.

In FIGS. 22, 23, 24 an additional tank 185 is provided. Tank 26 is for white fabric articles while tank 185 is used for colored fabric articles. Each tank 26, 185 has a water or fluid source 157. Header 186 receives flow from tank 185 and pump 188. Header 187 receives flow from tank 185 and pump 189. Line 190 receives flow from tank 26 and pump 152. Line 191 receives flow from tank 26 and pump 149. Line 190 transmits fluid from tank 26 to hopper 14. Header or line 191 connects with each of a plurality of branch flow lines 192. Each branch flow line 192 discharges to a module 1, 2, 3, 4, 5, 6, 7 or 8. The branch flow lines 192 can be valved flow lines.

Header or flow line 186 connects with each of a plurality of branch flow lines 193. Each branch flow line 193 can be valved. Each branch flow line 193 discharges to a module 1, 2, 3, 4, 5, 6, 7, 8. In FIG. 22, low temperature white linens follow high temperature white linens. In the example of FIG. 22, only modules 1,2 are low temperature (e.g., 50° C.). Modules 3-8 are high temperature (e.g., 70° C.).

In FIG. 23, the same arrangement of FIG. 22 is shown but after a transfer where the low temperature of module 2 has transferred to module 3 and the low temperature of module 1 has transferred to module 2.

FIG. 24 is similar to FIG. 22 but colored fabric articles replace the low temperature white fabric articles of FIG. 22. The high temperature white fabric articles of modules 2-8 of FIG. 22 are just white fabric articles in FIG. 24.

The following is a list of parts and materials suitable for use in the present invention.

PARTS LIST

| Part Number | Description |
|---|---|
| 1 | module |
| 2 | module |
| 3 | module |
| 4 | module |
| 5 | module |
| 6 | module |
| 7 | module |
| 8 | module |
| 9 | module |
| 10 | module |
| 10A | textile washing apparatus |
| 10B | textile washing apparatus |
| 10C | textile washing apparatus |
| 10D | textile washing apparatus |
| 10E | textile washing apparatus |
| 10F | textile washing apparatus |
| 10G | textile washing apparatus |
| 10H | textile washing apparatus |
| 10I | textile washing apparatus |
| 10J | textile washing apparatus |
| 11 | tunnel washer |
| 12 | inlet end portion |
| 13 | outlet end portion |
| 14 | hopper |
| 15 | discharge |
| 16 | soiled linen arrow |
| 17 | arrow |
| 18 | arrow |
| 19 | press/extractor |
| 20 | shuttle |
| 21 | dryer |
| 22 | transport |
| 23 | finishing station |
| 24 | extractor reuse tank |
| 25 | linen/fabric articles |
| 26 | pulse flow tank |
| 27 | conductivity sensor |
| 28 | conductivity sensor |
| 29 | conductivity sensor |
| 30 | influent flow line |
| 31 | flow meter |
| 32 | valve |
| 33 | valve |
| 34 | valve |
| 35 | flow line |
| 36 | valve |
| 37 | flow line |
| 38 | pump |
| 39 | valve |
| 40 | flow meter |
| 41 | valve |
| 42 | valve |
| 43 | sewer |
| 44 | flow line |
| 45 | pump |
| 46 | valve |
| 47 | flow meter |
| 48 | flow line |
| 49 | pump |
| 50 | influent flow line |
| 51 | flow meter |
| 52 | tee fitting |
| 53 | flow line |
| 54 | flow line |
| 55 | valve |
| 56 | valve |
| 57 | valve |
| 58 | pump |
| 59 | valve |
| 60 | valve |
| 61 | valve |
| 62 | sewer |
| 63 | valve |

-continued

PARTS LIST

| Part Number | Description |
|---|---|
| 64 | valve |
| 65 | flow line |
| 66 | flow line |
| 67 | tee fitting |
| 68 | flow line |
| 69 | pump |
| 70 | flow meter |
| 71 | tee fitting |
| 72 | flow line |
| 73 | ironer |
| 74 | chest |
| 75 | roller |
| 76 | arrow |
| 77 | dotted line |
| 78 | arrow |
| 79 | cold water source |
| 80 | hot water source |
| 81 | flow line |
| 82 | Tee-fitting |
| 83 | valve |
| 84 | flow meter |
| 85 | valve |
| 86 | Tee-fitting |
| 87 | Tee-fitting |
| 88 | flow line |
| 89 | valve |
| 90 | flow line |
| 91 | valve |
| 92 | flow line |
| 93 | flow meter |
| 94 | valve |
| 95 | Tee-fitting |
| 96 | valve |
| 97 | Tee-fitting |
| 98 | valve |
| 99 | flow meter |
| 100 | flow line |
| 101 | pump |
| 102 | flow line |
| 103 | flow line |
| 104 | flow line |
| 105 | Tee-fitting |
| 106 | Tee-fitting |
| 107 | Tee-fitting |
| 108 | Tee-fitting |
| 109 | flow line |
| 110 | flow line |
| 111 | flow line |
| 112 | flow line |
| 114 | valve |
| 115 | valve |
| 116 | valve |
| 117 | valve |
| 118 | valve |
| 120 | chemical dispenser |
| 121 | water header |
| 122 | pump |
| 123 | fill valve |
| 124 | fill valve |
| 125 | fill valve |
| 126 | fill valve |
| 127 | flow line |
| 128 | sewer |
| 129 | drain valve |
| 130 | drain valve |
| 131 | drain valve |
| 132 | counterflow valve |
| 133 | counterflow valve |
| 134 | counterflow valve |
| 135 | counterflow valve |
| 136 | valve |
| 137 | valve |
| 138 | valve |
| 139 | valve |
| 140 | arrow |

-continued

PARTS LIST

| Part Number | Description |
|---|---|
| 141 | counterflow line |
| 142 | counterflow line |
| 143 | counterflow line |
| 144 | valved drain lines |
| 145 | valved drain lines |
| 146 | valved recirculation line |
| 147 | transmitter |
| 148 | flow line |
| 149 | pump |
| 150 | branch line |
| 151 | line |
| 152 | pump |
| 153 | alkali detergent |
| 154 | chlorine bleach |
| 155 | antichlor solution |
| 156 | hydrogen peroxide |
| 157 | fluid source |
| 158 | valved flow line |
| 159 | sanitizing sour |
| 160 | sour solution |
| 161 | flow line |
| 162 | pump |
| 163 | pump |
| 164 | pump |
| 165 | pump |
| 166 | pump |
| 167 | pump |
| 168 | tee fitting |
| 169 | flow line |
| 170 | flow line |
| 171 | tee fitting |
| 172 | tee fitting |
| 173 | tee fitting |
| 174 | hot water source |
| 175 | tempered water source |
| 176 | alternate pulse flow header |
| 177 | alternate pulse flow header |
| 178 | valved branch line |
| 179 | ph sensor |
| 180 | valved branch line |
| 181 | valved branch line |
| 182 | valved branch line |
| 185 | tank |
| 186 | header |
| 187 | header |
| 188 | pump |
| 189 | pump |
| 190 | flow line |
| 191 | flow line |
| 192 | branch flow line |
| 193 | counterflow flow line |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of washing fabric articles in a continuous batch tunnel washer, comprising the steps of:

a) providing a continuous batch tunnel washer having an interior, an intake, a discharge, and a plurality of modules that segment the interior and wherein one of the modules is an empty pocket that is drained of water, said modules including a first module next to the intake and a final module next to the discharge;

b) moving the fabric articles from the intake to the discharge and through the modules in a sequence beginning with the first module and ending with the final module;

c) adding a washing chemical to one or more of the modules;

d) rinsing the fabric articles by counter flowing liquid in the washer interior along a flow path that is generally opposite the direction of travel of the fabric articles in steps "b" and "c";

e) wherein one of the modules defines an empty pocket module that does not contain fabric articles and that is drained of fluid during step "d"; and f) wherein the modules that are not empty pocket modules contain both fabric articles and fluid.

2. The method of claim 1 further comprising extracting excess fluid from the fabric articles after step "e".

3. The method of claim 2 wherein the empty pocket is moved from an upstream location to a downstream location.

4. The method of claim 1 wherein the empty pocket separates white fabric articles from non-white fabric articles.

5. The method of claim 1 wherein the empty pocket separates white fabric articles from colored fabric articles.

6. The method of claim 1 wherein the empty pocket separates higher temperature modules from lower temperature modules.

7. The method of claim 1 wherein there are multiple different counterflow streams in step "d".

8. The method of claim 4 wherein there are multiple different counterflow streams in step "d".

9. The method of claim 8 wherein one counterflow stream in step "d" rinses white fabric articles and another counterflow stream rinses non-white fabric articles.

10. The method of claim 8 wherein counterflow stream in step "d" rinses white fabric articles and another counterflow rinses colored fabric articles.

11. The method of claim 6 wherein there are multiple different counterflow streams in step "d".

12. The method of claim 11 wherein one counterflow stream rinses higher temperature modules and another counterflow stream rinses lower temperature modules.

13. A method of laundering fabric articles in a continuous batch tunnel washer, comprising the steps of:

a) providing a continuous batch tunnel washer having an interior, an intake, a discharge, and a plurality of modules that segment the interior;

b) moving the fabric articles and fluid in a first direction of travel from the intake to the discharge;

c) washing the fabric articles with a chemical bath in one or more of said modules;

d) rinsing the fabric articles after step "c";

e) providing an empty pocket in one or more of said modules that does not contain fabric articles and that is drained of fluid;

f) wherein the empty pocket is moved from one module to the next module in sequence, and in a direction from the intake towards the discharge; and g) counterflowing liquid in the washer during step "d".

14. The method of claim 13 wherein the empty pocket separates white fabric articles from non-white fabric articles.

15. The method of claim 13 wherein the empty pocket separates white fabric articles from colored fabric articles.

16. The method of claim 13 wherein the empty pocket separates higher temperature modules from lower temperature modules.

17. The method of claim 14 wherein there are multiple different counterflow streams in step "d".

18. The method of claim 15 wherein there are multiple different counterflow streams in step "d".

19. The method of claim 18 wherein one counterflow stream in step "d" rinses white fabric articles and another counterflow stream rinses non-white fabric articles.

20. The method of claim 18 wherein one counterflow stream in step "d" rinses white fabric articles and another counterflow stream rinses colored fabric articles.

21. The method of claim 16 wherein one counterflow stream rinses higher temperature modules and another counterflow stream rinses lower temperature modules.

22. A method of washing fabric articles in a continuous batch tunnel washer, comprising the steps of:

a) providing a continuous batch tunnel washer having an interior, an intake, a discharge, and a plurality of modules that segment the interior and wherein one of the modules is an empty pocket that is drained of water;

b) moving the fabric articles and a volume of liquid from the intake to the discharge and through the modules in sequence;

c) adding a washing chemical to one or more of the modules;

d) rinsing the fabric articles by counter flowing liquid in the washer interior along a flow path that is generally opposite the direction of travel of the fabric articles in steps "b" and "c"; and e) wherein one of the modules defines an empty pocket module that does not contain fabric articles and that is drained of liquid during step "d", and f) wherein the empty pocket module moves from one module position to another module position.

23. The method of claim 22 further comprising extracting excess fluid from the fabric articles after step "e".

24. The method of claim 22 wherein the empty pocket is moved from an initial upstream location to downstream modules that are downstream of said initial upstream location.

25. The method of claim 22 wherein the empty pocket separates white fabric articles from non-white fabric articles.

26. The method of claim 22 wherein the empty pocket separates white fabric articles from colored fabric articles.

27. The method of claim 22 wherein the empty pocket separates one or more higher temperature modules from one or more lower temperature modules.

28. A method of laundering fabric articles in a continuous batch tunnel washer, comprising the steps of:

a) providing a continuous batch tunnel washer having an interior, an intake, a discharge, and a plurality of modules that segment the interior and including at least one intake module and at least one final module;

b) moving the fabric articles in a first direction of travel from the intake to the discharge;

c) washing the fabric articles with a chemical bath in one or more of said modules;

d) rinsing the fabric articles after step "c";

e) providing an empty pocket in one or more of said modules that does not contain fabric articles and that is drained of fluid;

f) wherein the empty pocket is moved one module at a time starting at the intake module and ending at the final module, and in a direction from the intake towards the discharge; and g) counterflowing liquid in the washer during step "d".

29. The method of claim 28 wherein the empty pocket separates white fabric articles from non-white fabric articles.

30. The method of claim 28 wherein the empty pocket separates white fabric articles from colored fabric articles.

31. The method of claim 28 wherein the empty pocket separates higher temperature modules from lower temperature modules.

32. The method of claim 28 wherein there are multiple different counterflow streams in step "g".

33. The method of claim 32 wherein one counterflow stream in step "d" rinses white fabric articles and another counterflow stream rinses non-white fabric articles.

34. The method of claim 32 wherein one counterflow stream in step "d" rinses white fabric articles and another counterflow stream rinses colored fabric articles.

35. The method of claim 32 wherein one counterflow stream rinses higher temperature modules and another counterflow stream rinses lower temperature modules.

* * * * *